US007552877B2

(12) United States Patent
Grant

(10) Patent No.: US 7,552,877 B2
(45) Date of Patent: Jun. 30, 2009

(54) WATER DEFLECTION ASSEMBLY

(75) Inventor: Stuart Francis Grant, Long Beach, CA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 220 days.

(21) Appl. No.: 11/266,054

(22) Filed: Nov. 3, 2005

(65) Prior Publication Data

US 2006/0091232 A1 May 4, 2006

Related U.S. Application Data

(60) Provisional application No. 60/624,609, filed on Nov. 3, 2004.

(51) Int. Cl.
*B05B 3/04* (2006.01)

(52) U.S. Cl. ..... 239/222.15; 239/380; 239/382; 239/389; 239/222.17; 239/17; 239/25; 446/129; 446/236

(58) Field of Classification Search ..... 239/380, 239/381, 382, 383, 389, DIG. 11, 222.11, 239/222.15, 222.17, 16, 17, 25, 26, 27, 29.3, 239/289, 146; 446/236, 129
See application file for complete search history.

(56) References Cited

U.S. PATENT DOCUMENTS

| | | | | |
|---|---|---|---|---|
| 172,024 | A | 1/1876 | Hug | |
| 453,055 | A | 5/1891 | Ware | |
| 458,607 | A | 9/1891 | Weiss | |
| 461,415 | A | 10/1891 | Bonnette | |
| 477,164 | A | 6/1892 | Baker | |
| 510,496 | A | 12/1893 | Anderson | |
| 575,417 | A | 1/1897 | Cyrenius | |
| 581,252 | A | 4/1897 | Quayle | |
| 1,933,428 | A | 10/1933 | Harry | |
| 2,493,595 | A | 1/1950 | Rieger | |
| 2,848,276 | A | 8/1958 | Clearman | |
| 3,030,032 | A | 4/1962 | Luhman, Jr. | |
| 3,034,728 | A | 5/1962 | Hruby, Jr. | |
| 3,312,400 | A | 4/1967 | Clearman | |
| 3,532,273 | A | 10/1970 | Siddall et al. | |
| 3,958,643 | A | 5/1976 | Landsberg | |
| 3,964,685 | A | 6/1976 | Chauvigne | |
| 4,073,438 | A | 2/1978 | Meyer | |
| 4,205,785 | A * | 6/1980 | Stanley | 239/17 |
| 4,440,345 | A * | 4/1984 | Figwer et al. | 239/237 |

(Continued)

OTHER PUBLICATIONS

Grant, entitled, "Water Deflection Subassembly," U.S. Appl. No. 60/784,295, filed Mar. 21, 2006, pending.

(Continued)

*Primary Examiner*—Len Tran
*Assistant Examiner*—Trevor E McGraw
(74) *Attorney, Agent, or Firm*—Nixon & Vanderhye, P.C.

(57) ABSTRACT

According to one aspect of the present invention, a system for deflecting and distributing liquid from a liquid source is provided. The system comprises a dispersing element disposed along an elongated member, and a retaining structure adapted to enclose at least a portion of the elongated member. The dispersing element further comprises a series of diagonal, spaced grooves configured to receive and deflect the liquid. The dispersing element and the elongated member are configured to rotate and precess relatively freely within the retaining structure.

23 Claims, 20 Drawing Sheets

U.S. PATENT DOCUMENTS

| | | | | |
|---|---|---|---|---|
| 4,487,368 | A | 12/1984 | Clearman | |
| 5,060,862 | A * | 10/1991 | Pacht | 239/252 |
| 5,224,652 | A | 7/1993 | Kessler | |
| 5,236,126 | A * | 8/1993 | Sawade et al. | 239/252 |
| 5,280,813 | A | 1/1994 | Jackson | |
| 5,381,960 | A * | 1/1995 | Sullivan et al. | 239/222.21 |
| 5,439,174 | A | 8/1995 | Sweet | |
| 5,588,595 | A | 12/1996 | Sweet et al. | |
| 5,597,119 | A * | 1/1997 | Gorney et al. | 239/241 |
| 5,671,885 | A | 9/1997 | Davisson | |
| 5,697,392 | A | 12/1997 | Johnson et al. | |
| 5,950,927 | A * | 9/1999 | Elliott et al. | 239/222.21 |
| 6,092,739 | A | 7/2000 | Clearman et al. | |
| 6,129,293 | A | 10/2000 | Jager | |
| 6,161,771 | A | 12/2000 | Henry | |
| 6,176,440 | B1 | 1/2001 | Elliott | |
| 6,245,014 | B1 * | 6/2001 | Brainard, II | 600/300 |
| 6,261,186 | B1 * | 7/2001 | Henry | 472/128 |
| 6,267,299 | B1 * | 7/2001 | Meyer | 239/222.17 |
| 6,360,965 | B1 * | 3/2002 | Clearman et al. | 239/222.19 |
| 6,382,525 | B1 | 5/2002 | Santiesteban et al. | |
| 6,431,475 | B1 | 8/2002 | Williams | |
| 6,439,477 | B1 | 8/2002 | Sweet et al. | |
| 6,766,967 | B2 * | 7/2004 | Harris et al. | 239/251 |
| 6,793,152 | B1 * | 9/2004 | Drechsel | 239/251 |
| 6,932,279 | B2 | 8/2005 | Burcham | |
| 7,100,838 | B1 * | 9/2006 | Epstein | 239/33 |
| 7,111,796 | B2 * | 9/2006 | Olson | 239/452 |
| 2005/0087622 | A1 * | 4/2005 | Burcham | 239/222.17 |
| 2006/0091232 | A1 | 5/2006 | Grant | |
| 2006/0108445 | A1 * | 5/2006 | Pinch et al. | 239/222.21 |

OTHER PUBLICATIONS

Grant, entitled, "Fluid Distributing Device and Method," U.S. Appl. No. 60/901,562, filed Feb. 14, 2007, pending.

Grant, entitled, "Fluid Distributing Device and Method," U.S. Appl. No. 12/068,908, filed Feb. 13, 2008, pending.

* cited by examiner

WATER DEFLECTION ASSEMBLY

CROSS-REFERENCE TO RELATED APPLICATION

This application claims the benefit of U.S. Provisional Application No. 60/624,609, filed Nov. 3, 2004, the entirety of which is hereby incorporated by reference.

BACKGROUND OF THE INVENTION

1. Field of the Invention

This invention relates generally to a device for deflecting and distributing liquids and, in particular, to a mechanism suitable for spreading or distributing relatively small amounts of water.

2. Description of the Related Art

Sprinklers of various types and sizes are used in a number of environments. In one common implementation, a sprinkler system is used to water a lawn. The challenge in watering a lawn is, of course, to achieve a relatively even dispersion of water from a point source. Different sprinklers surmount this obstacle using different methods. A very simple example of a sprinkler system is the watering can. A relatively large amount of water is poured through a large area spout having a number of holes therethrough. The water travels through the holes along a number of trajectories and is thereby dispersed.

A number of other sprinkler systems operate via turbine or jet power. The flow from a relatively high volume of water is thereby converted into linear or rotational force. This force is then used to operate some sort of mechanical disperser, which evenly distributes the water. These systems operate fairly well for many applications, especially when watering a significant amount of land, where a large flow of water is necessary and desirable.

Unfortunately, these prior art water dispersion and sprinkler systems require this relatively high water pressure to operate correctly. Therefore, these devices are ill-suited for low-flow applications, such as, for example, precision watering of a single plant, watering on steep inclines prone to water runoff, or watering of highly packed soil that is resistant to absorption.

SUMMARY OF THE INVENTION

According to one embodiment of the present invention, a system for deflecting and distributing liquid from a liquid source is provided. The system comprises a dispersing element, which may be conical, disposed along a rod, and a retaining structure, for example a ring, adapted to enclose at least a portion of the rod. The dispersing element further comprises a series of spaced grooves, ridges or other structure configured to receive and/or deflect the liquid. The dispersing element and the rod are configured to rotate or spin and/or precess relatively freely within the retaining ring.

In one embodiment, the rod is coupled to a magnet, and the system includes an opposing magnet adapted to direct a force to the rod in a direction generally opposite that of liquid flow.

In one embodiment, a device for dispersing liquid has an elongated member and a dispersing element attached thereto. At least one deflecting groove is situated on the dispersing element. At least one retaining structure surrounds the elongated member and confines its movement. The elongated member is maintained above a base surface and within the at least one retaining structure by at least one set of magnets. Liquid directed towards the dispersing element is deflected by the at least one deflecting groove in a generally radial direction away from the dispersing member. The deflection of the liquid away from the dispersing element causes the dispersing element and the elongated member to rotate about a common longitudinal axis. The rotation of the dispersing element and the elongated member further causes the elongated member to precess within the at least one retaining structure. As the liquid contacts the dispersing element during precession, it is distributed throughout a generally circular area around the device.

In one embodiment, a device for dispersing liquid has an elongated member and a dispersing element provided thereon. A retaining structure surrounds the elongated member. Liquid directed towards the dispersing element is deflected by the dispersing member in a generally radial direction away from the dispersing member. The deflection of the liquid away from the dispersing element causes the dispersing element and the elongated member to rotate about a common longitudinal axis. The rotation of the dispersing element and the elongated member further causes the elongated member to precess within the retaining structure. As the liquid contacts the dispersing element during precession, it is distributed throughout a generally circular area around the device.

In one embodiment, a method for dispersing liquid includes providing an elongated member having a dispersing element attached thereto. Liquid is directed towards the dispersing element, and as it contacts the dispersing element, liquid is deflected in a generally radial direction away from the dispersing member. This causes the dispersing member and elongated member to rotate within a retaining structure about a common longitudinal axis.

BRIEF DESCRIPTION OF THE DRAWINGS

The preferred embodiments of this invention, illustrating all its features, will now be discussed in detail. These embodiments depict the novel and nonobvious method and system of this invention shown in the accompanying drawings, which are for illustrative purposes only. The drawings include the following Figures, with like numerals indicating like parts.

DETAILED DESCRIPTION OF THE PREFERRED EMBODIMENTS

In one embodiment of the present invention, a water deflection assembly is disclosed that can be used to disperse water or other liquids. In order to do so, one embodiment of the present invention includes a dispersing element, which is preferably a substantially conical element, having grooves or ridges disposed on its external surface. As water contacts this surface, the conical element and an elongated member to which it is situated or attached are caused to spin about their longitudinal axes. The conical element and the elongated member may be supported in a relatively frictionless environment, preferably by use of magnets in one embodiment, allowing the conical element and the elongated member to precess relatively freely around the retaining structure. As the conical element precesses, water contacting its external surface is deflected from the conical element at different angles, and the water is thereby dispersed.

Figure 1:
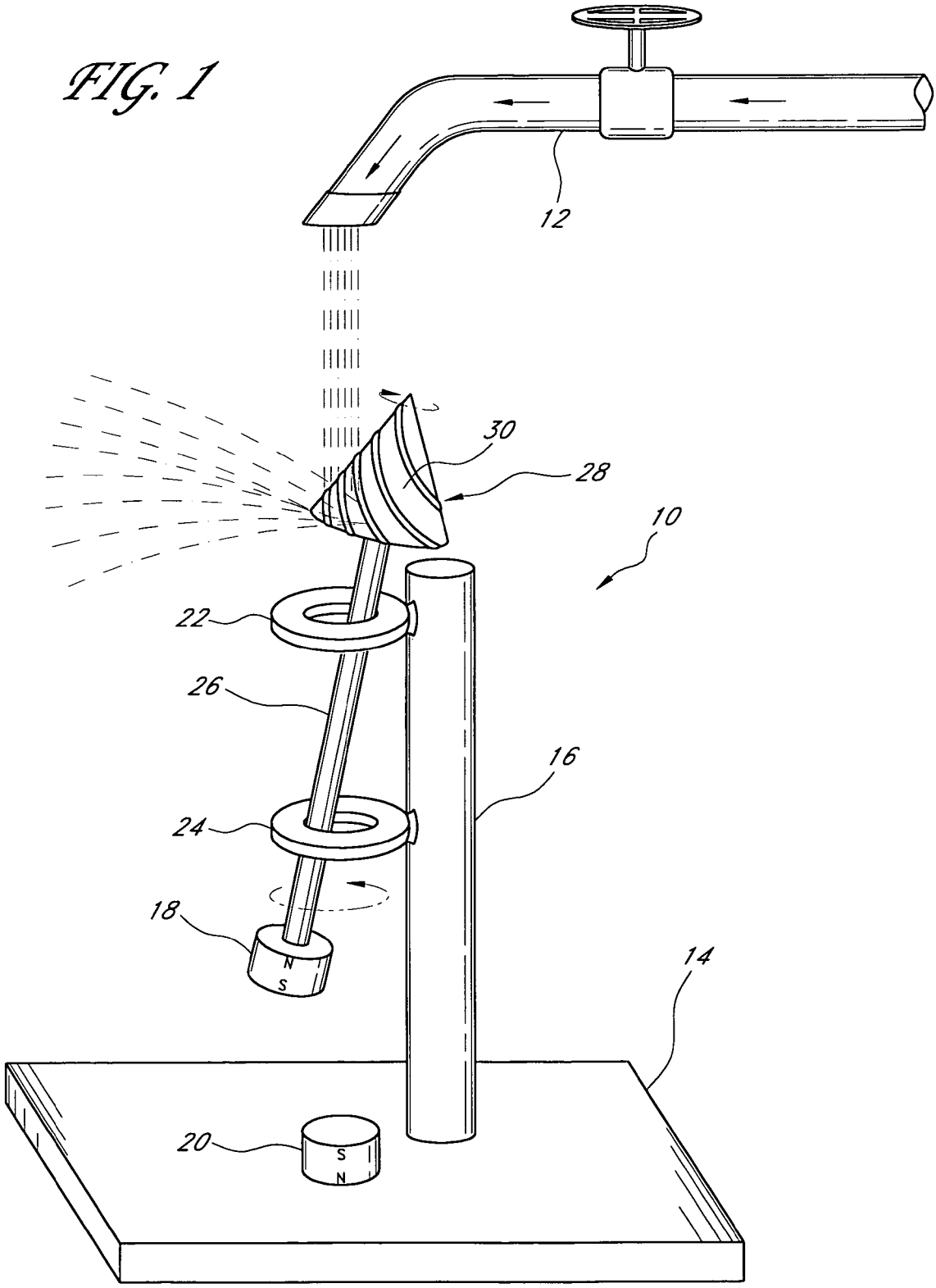
FIG. 1 shows a perspective view of a water deflection assembly according to one embodiment of the present invention.

FIG. 1 illustrates one embodiment of a water deflection assembly 10. As illustrated, a liquid outlet 12, such as a water jet, is located above the water deflection assembly 10, which liquid outlet 12 represents the point source of water that should be dispersed. This liquid outlet 12 is preferably located along a central axis of the assembly 10 and is fixed relative thereto. Although not shown, some structure for attaching the liquid outlet 12 and the components of the assembly 10 is therefore preferable. In some embodiments, the deflected liquid need not be water, but may be any of a number of liquids. In fact, in one embodiment, the liquid may comprise liquid metal for forming ball bearings. In other embodiments, the liquid may comprise, for example, biological broths or liquid chemicals undergoing heat-generating reactions that may be advantageously cooled or oxidized as they form droplets dispersed through the air. As shown in FIG. 1, the liquid flowing from the liquid outlet 12 is propelled by gravity. However, in other embodiments, a variety of pumps or other means for moving water against gravity may be used to propel the water towards the water deflection assembly 10.

As shown in FIG. 1, the water deflection assembly 10 may comprise a base 14 and supporting pole 16, two opposing magnets 18, 20, retaining rings 22, 24, an elongated member or a rod 26 and a dispersing element 28. The base 14 and supporting pole 16 are used to maintain the relative positions of the other elements of the water deflection assembly 10 and may be manufactured in a variety of ways well known to those of skill in the art. In one embodiment, the base may simply be the earth from which a plant is growing, and a supporting pole may extend generally vertically or vertically from the earth to maintain the relative positions of other elements of the water deflection assembly, including, for example, the opposing magnet 20. In another embodiment (best seen in FIG. 8), the supporting pole may not be a separate element but may be formed integrally with the retaining rings. In another embodiment (best seen in FIG. 6), the base 14, the retaining structure 34 for the rod 26 and a support for the liquid outlet 12 may be incorporated into a single larger structure 36. The base 14 and pole 16 may be constructed from any of a number of rigid or semi-rigid materials and may or may not be made from the same material. In a preferred embodiment, the supporting pole 16 and base 14 may be constructed from a rigid, inexpensive plastic material.

The supporting pole 16 supports the retaining rings 22, 24, one located above the other. These rings 22, 24 may be constructed of the same or different materials and are preferably constructed from a rigid or semi-rigid material having a relatively low coefficient of friction. The diameter of the upper ring 22 may be identical, smaller or larger than that of the lower ring 24. The rings 22, 24 may also be centered about the same or a different axis. As illustrated, the rings 22, 24 have identical radii and are concentric about the same longitudinal axis. Of course, more or fewer rings may be used in other embodiments. For example, in one embodiment, a single thicker ring may be used to support the rod 26 and dispersing element 28. In another embodiment, three or more rings may be used to provide further security for the rod 26 and dispersing element 28. In still another embodiment, a toothed ring 42 may be used to drive a mechanical gear. This embodiment is discussed in further detail below, with reference to FIG. 11.

In the illustrated embodiment, the dispersing element 28 is attached to an upper end of the rod 26, and the rod 26 is retained within the retaining rings 22, 24. The rod 26 contacts the retaining rings 22, 24 at one point on each retaining ring. The rod 26 may be constructed from any of a number of rigid materials and has a length equal to or greater than the distance between the retaining rings 22, 24. The rod 26 may also have a narrower width than the width of the narrowest retaining ring, such that the rod 26 may move relatively freely within the retaining rings 22, 24. In some embodiments, the rod 26 may be further constructed with a variable thickness along its length.

As illustrated, the dispersing element 28 may have any of a variety of shapes. In fact, the dispersing element 28 may have any of a number of shapes along which grooves or ridges can be disposed, including a conical or a spherical shape. In one embodiment, the dispersing element 28 need not be tapered, as the rod 26 leans and precesses at an angle relative to the axis of the impinging water. The dispersing element 28 is preferably rigid and may be constructed from the same or different materials as the rod 26 to which it is attached. As may be seen in FIG. 1, the dispersing element 28 has diagonal grooves 30 disposed thereon. These grooves 30 may have a variety of shapes and configurations. In one embodiment, these grooves 30 curve along the surface of the dispersing element 28 and may be fairly shallow. However, in other embodiments, at least a subset of the grooves may be more or less diagonal and may have varying depths and spacing between them. The dispersing element 28 need not be conical but can have any suitable shape for dispersing liquid.

In one embodiment, at a lower end of the rod 26, at the opposite end of dispersing element 28, the rod 26 is attached to a magnet 18. As illustrated, this magnet 18 has its South pole facing downwards, and its North pole facing upwards. Of course, these polarities may be otherwise disposed in other embodiments. The magnet 18 may comprise any of a number of magnetic materials well-known to those of skill in the art. In a preferred embodiment, the magnet 18 comprises a ferromagnetic material. The magnet 18 attached to the rod 26 may also be attached at various locations, more or less proximal to the conical element 28, or on either side of the conical element 28, as will be apparent from the remaining Figures.

Located on or near the base 14, another magnet 20 may be oriented to oppose the magnet 18 attached to the rod 26. Of course, those of skill in the art will recognize that the exact orientation of the magnets is not important, so long as the magnets are oriented to oppose one another's polarity and thus create a repelling force. Thus, the rod 26 is forced away from the base 14 and hangs suspended within the retaining rings 22, 24. The magnets 18, 20 allow the rod 26 and dispersing element 28 to remain suspended between the liquid outlet 12 and the base 14 with relatively little friction impeding their rotation and precessing. Of course, in other embodiments, other means of reducing friction may be used. For example, the lower end of the rod 26 and upward facing floor of the base 14 may comprise two materials that have very low coefficients of friction, such as PTFE against smooth metal or a plastic flotation device against a liquid surface. Alternatively, the upward facing floor of the base 14 may comprise a material that, when wet, has a very low coefficient of friction.

The embodiment of FIG. 1 will now be described in operation. In an inactive state, the rod 26 is suspended above the base 14 by the upward force created by the two magnets 18, 20. In this inactive state, the rod 26 will orient itself such that it contacts the upper ring 22 at a point 180 degrees from the point at which it contacts the lower ring 24, thus lowering the potential energy of this system.

When water is allowed to fall from the liquid outlet 12, it contacts the external surface of the dispersing element 28 as shown. The water then flows along the diagonal grooves 30. The weight of the water and the force with which the water contacts the grooves causes the dispersing element 28 to spin about its longitudinal axis. As the water is deflected outwardly, a force is imposed on the dispersing element 28 in the opposite direction of the deflected liquid forcing the rod 26 against the upper ring 22. Since the grooves 30 are oriented diagonally along the dispersing element 28, the force from the water may also impart a tangential component to the dispersing element 28, thus spinning the rod 26 and dispersing element 28. In the illustrated embodiment, the dispersing element 28 spins in a clockwise direction viewed from the top.

As soon as the water starts to contact the dispersing element 28, the dispersing element 28 also experiences an additional downward force, and thus the rod 26 and dispersing element 28 are reoriented in a lower position relative to their inactive state, and thus necessarily increasing the repelling force.

As is well known to those of skill in the art, as the dispersing element 28 is spun clockwise about its longitudinal axis, the rod 26 and dispersing element 28 precess counter-clockwise within the rings 22, 24. As these elements of the assembly precess, the water flowing from the liquid outlet 12 is deflected at a variety of angles and is thereby distributed around the water deflection assembly 10. Since the rod 26 and dispersing element 28 are supported magnetically and experience relatively little friction with the retaining rings 22, 24, very little water flow is required to drive this simple turbine.

Figure 2:
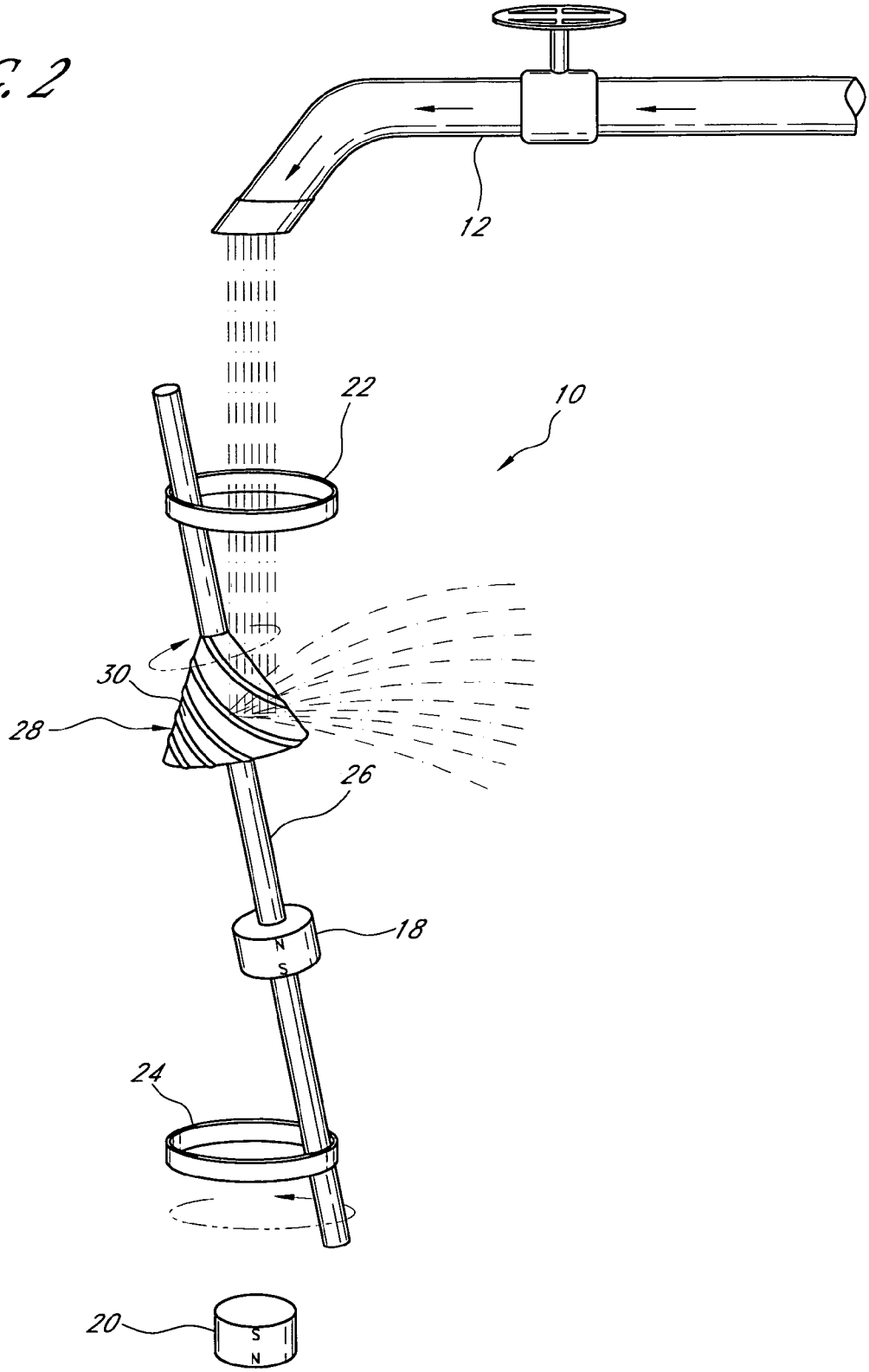
FIG. 2 shows a perspective view of a water deflection assembly according to a second embodiment of the present invention.

In FIG. 2, another embodiment of the present invention is shown (with the supporting pole not shown). In this embodiment, both the dispersing element 28 and rod-attached magnet 18 are located at intermediate locations along the rod 26 and between the retaining rings 22, 24 rather than at either end of the rod 26. This embodiment of the water deflection assembly 10 should function in substantially the same way as that described above, with reference to FIG. 1.

Figure 3:
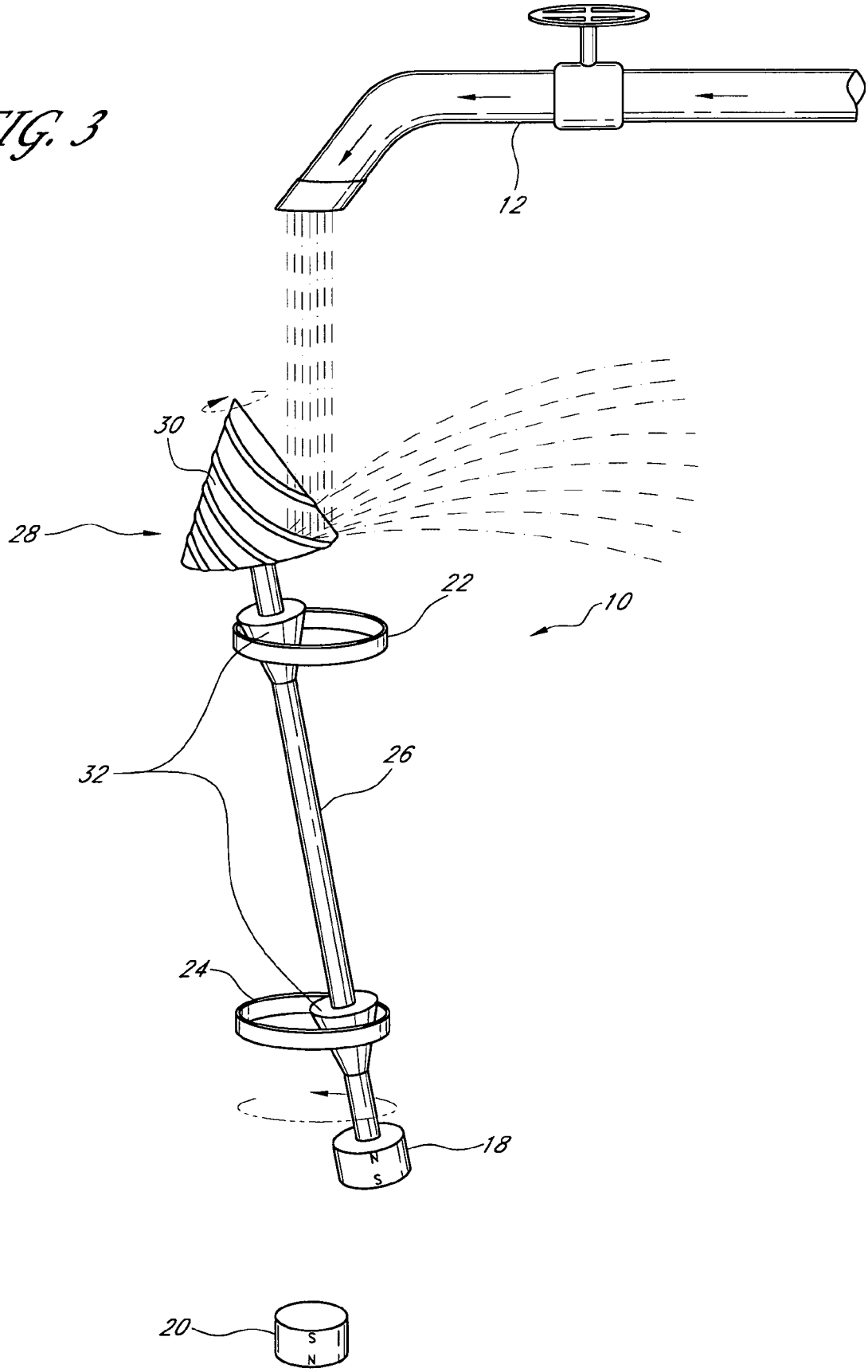
FIG. 3 shows a perspective view of a water deflection assembly according to a third embodiment of the present invention.

In FIG. 3, yet another embodiment of the present invention is shown (with the supporting pole not shown). FIG. 3 shows an embodiment substantially similar to that of FIG. 1. However, flared portions 32 of the rod 26 lie adjacent the retaining rings 22, 24. These flared portions 32 engage the rings 22, 24 to reduce the vertical travel of the rod 26 when water is deflected by the dispersing element 28. The flared portions 32 reduce this vertical travel by transforming the outward force of the rod 26 against the rings 22, 24 into an upwards acting force as the flared portions 32 of the rod 26 roll against the rings 22, 24. Preferably, the flared portions are conical in shape with the top of the cone pointing downward.

Figure 4:
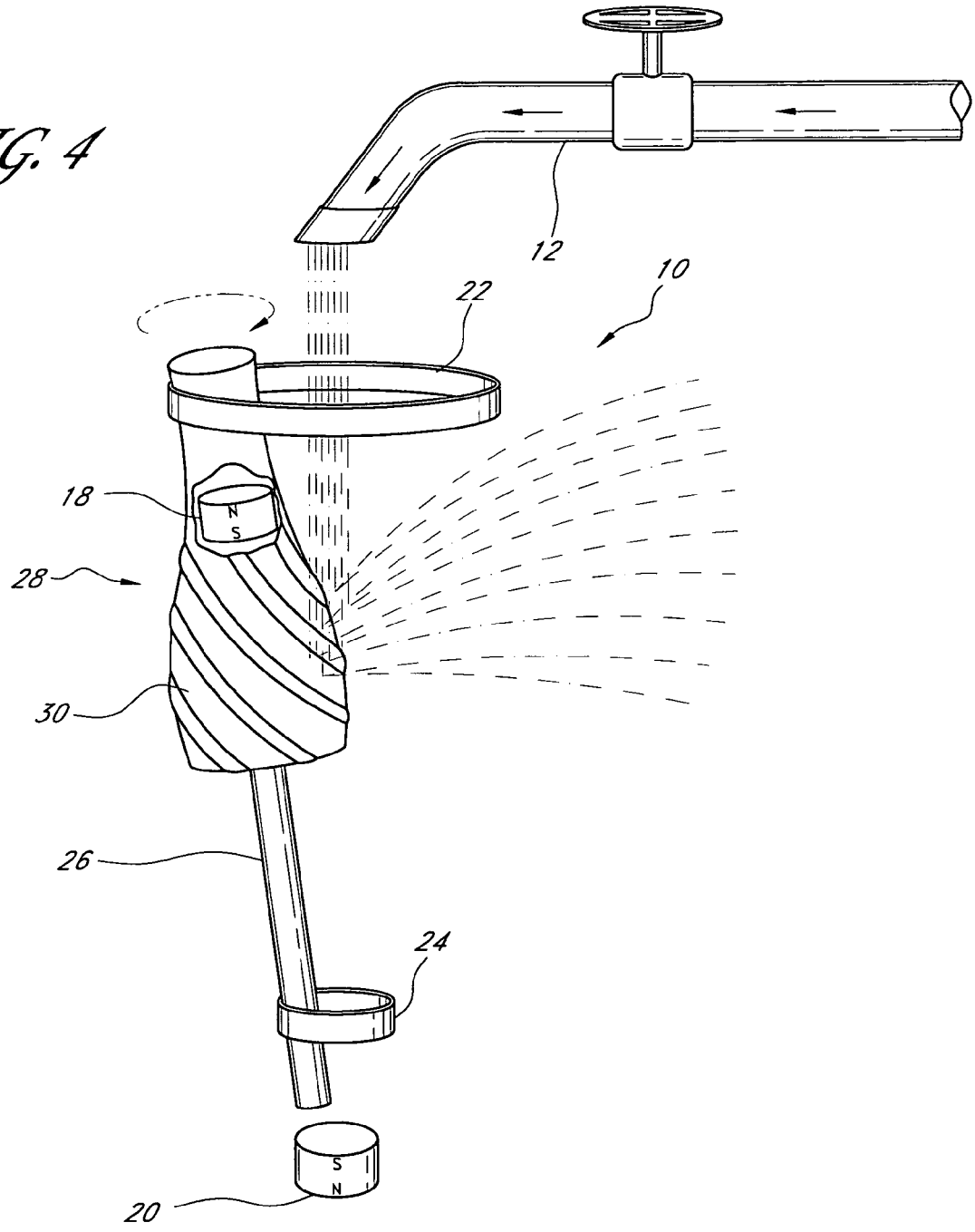
FIG. 4 shows a perspective view of a water deflection assembly according to a fourth embodiment of the present invention.

In FIG. 4, yet another embodiment of the present invention is shown (with the supporting pole not shown). The retaining rings 22, 24 have differing radii in this embodiment, and the magnet 18 is disposed near the upper end of the rod 26, and may be embedded in the rod. However, the rod 26 also has a varying radius along its length, and, in a preferred embodiment, the ratio of the rod's circumference to the adjacent ring's circumference remains constant. As a result, the rod 26 and dispersing element 28 precess similarly to the above embodiments, but, as illustrated, the rod 26 lies against the same side of both retaining rings 22, 24, as this orientation now minimizes the potential energy of the system. The force of the water in this embodiment is opposed both by the force between the two magnets 18, 20 as well as the outwardly directed force of the rod 26 as it rotates within the retaining rings, which force has an upwardly directed component.

Figure 5A:
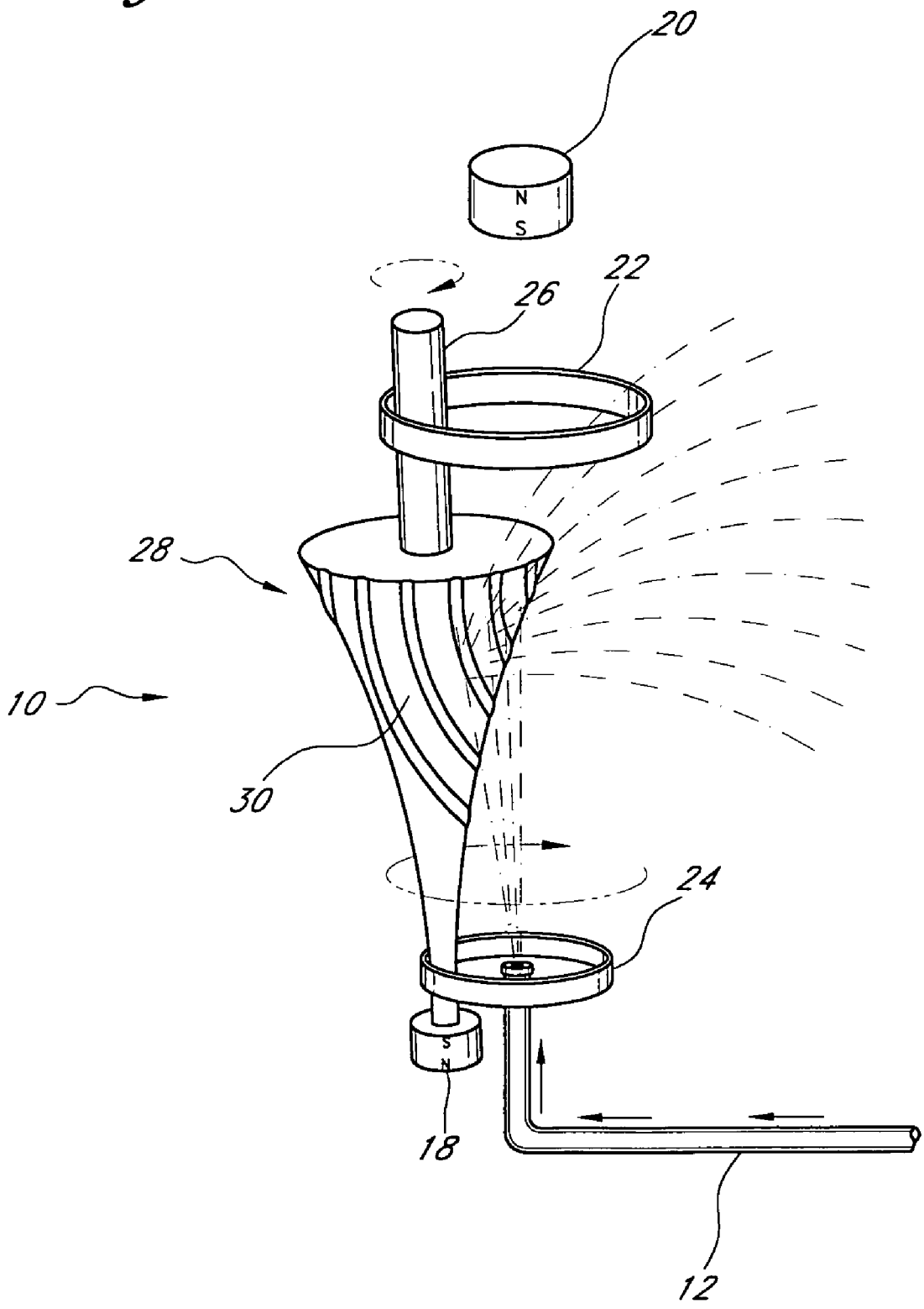
FIG. 5*a* shows a perspective view of a water deflection assembly according to a fifth embodiment of the present invention.

In FIG. 5*a*, yet another embodiment of the present invention is shown (with the supporting pole not shown). In this embodiment, the retaining rings 22, 24 once again have differing radii. In addition, the dispersing element 28 is oriented towards the ground, opposite of the orientation in the previously discussed embodiments, and the water is shot up through the lower retaining ring 24 towards the dispersing element 28. In FIG. 5*a*, oppositely oriented magnets 18, 20 are used to maintain a downward force on the dispersing element 28 and the rod 26. However, magnets need not be used to make this particular embodiment work. In one embodiment, the force of the water against the dispersing element 28 may counteract the force of gravity during use, such that the rod 26 and dispersing element 28 can precess relatively freely around the rings 22, 24. In many of the embodiments discussed herein, magnets need not be used, allowing instead the centrifugal force of the rotating rod 26 and/or the force of gravity to counteract the force of the impinging water jet. In still other embodiments, the rod 26 may be constructed with multiple dispersing elements 28, and water may strike these dispersing elements 28 from multiple directions, thereby suspending the rod 26 without the use of magnets. In a preferred embodiment, the dispersing elements 28 may be mounted on either end of the rod 26 in a symmetrical configuration, and the water jets may be directly opposing.

Figure 5B:
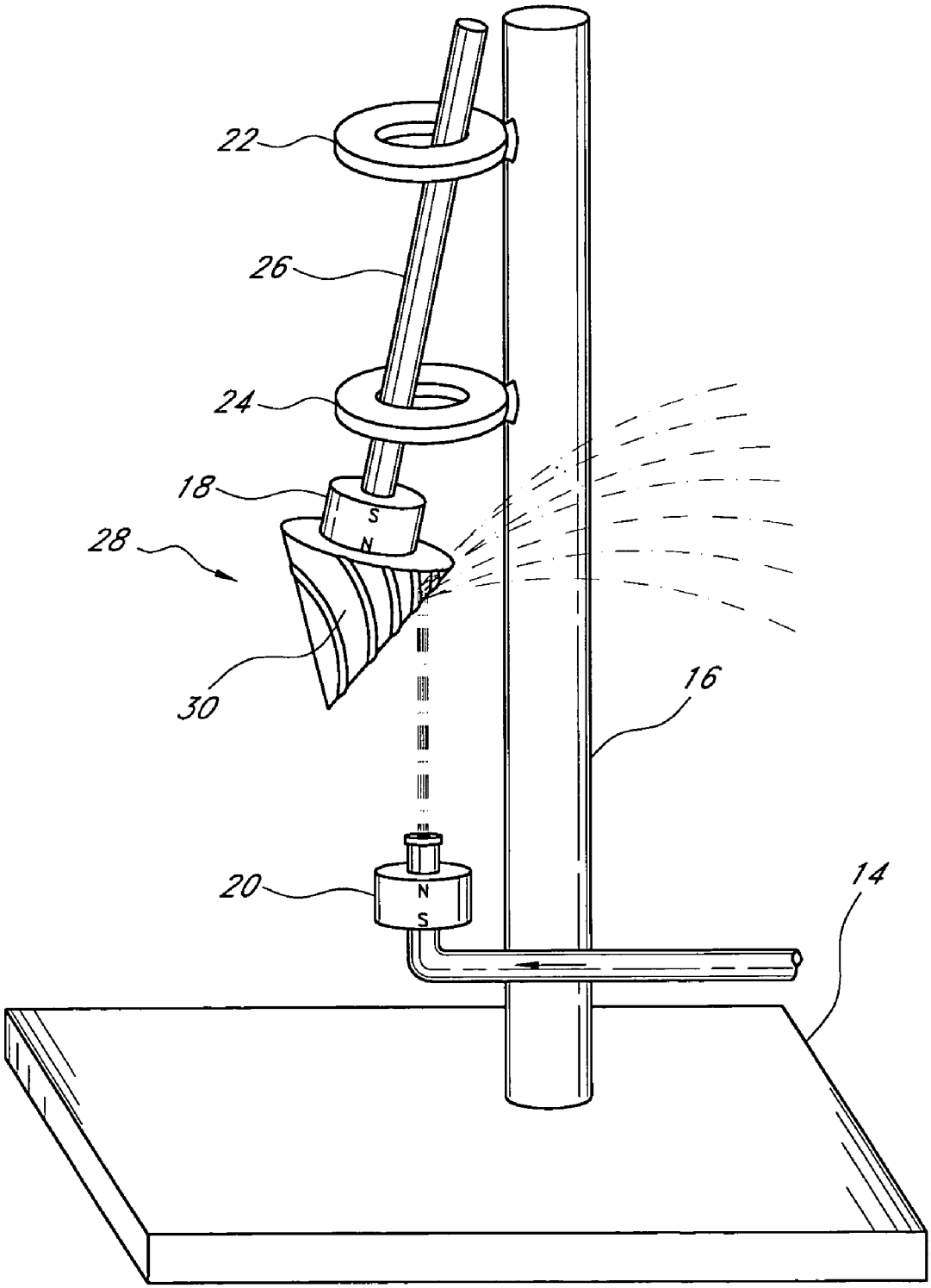
FIG. 5*b* shows a perspective view of a water deflection assembly according to a sixth embodiment of the present invention.

In FIG. 5*b*, another embodiment of the present invention is shown. As in FIG. 5*a*, the dispersing element 28 is oriented towards the ground, and the water is shot up from the base 14 towards the dispersing element 28. In FIG. 5*b*, oppositely oriented magnets 18, 20 are used to maintain the rod 26 within the retaining rings 22, 24 when the device is not operating. As liquid is forced from the liquid outlet 12, it will contact the dispersing element 28 and be dispersed away from the dispersing element 28. In addition, the force of the liquid on the dispersing element 28 will impose an upwards force on the dispersing element 28 and rod 26. This force may move the dispersing element 28 and rod 26 upwards, further away from the liquid outlet 12. In fact, the distance between the magnet 18 disposed on the rod 26 and the magnet 20 located on the liquid outlet 12 may increase to a distance so that the opposing magnetic forces are minimized or eliminated. Therefore, the upward force on the dispersing element 28 created by the liquid contact may be countered solely by the centrifugal force of the rotating rod 26 and/or the force of gravity.

Figure 6:
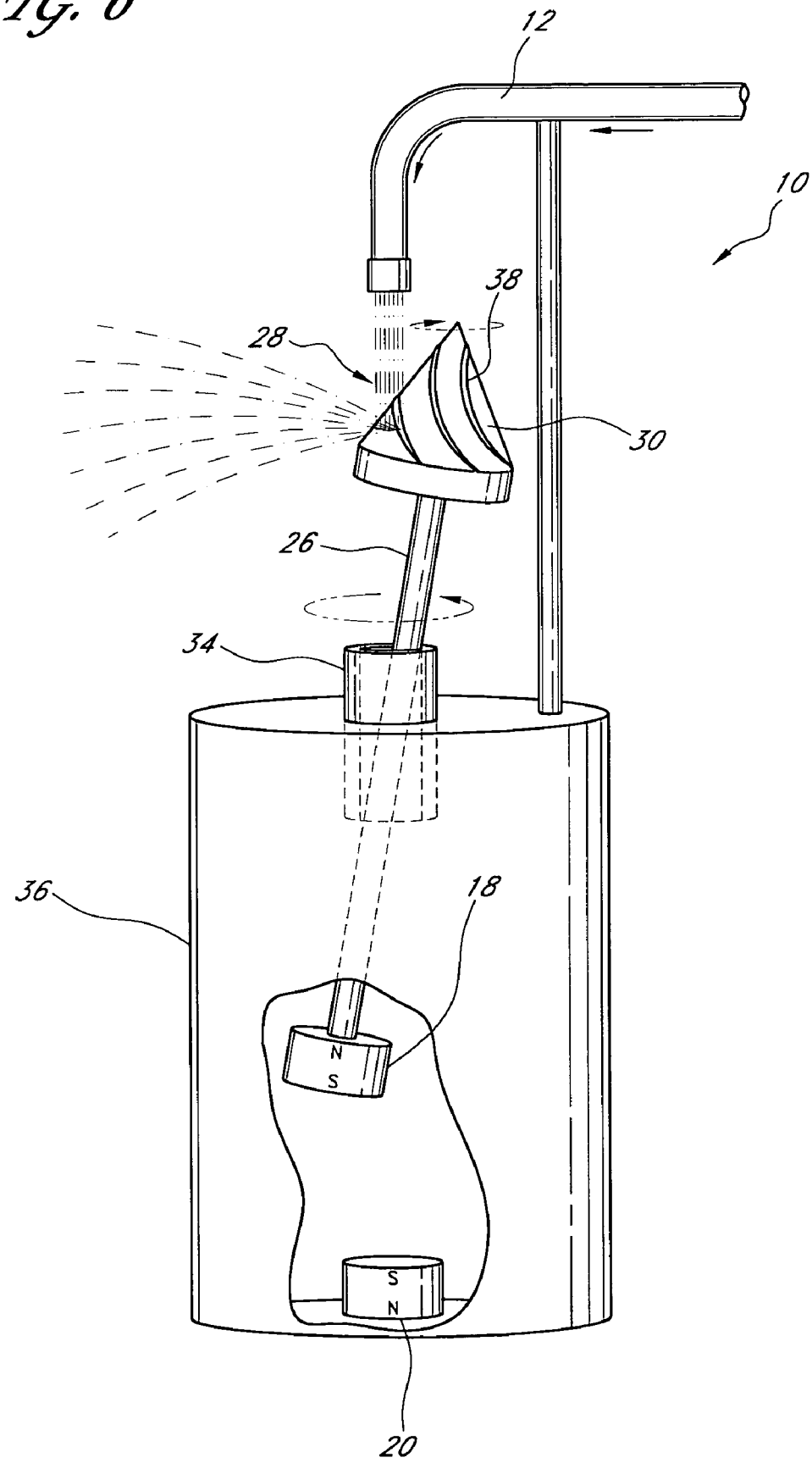
FIG. 6 shows a perspective view of a water deflection assembly according to a seventh embodiment of the present invention.
Figure 7:
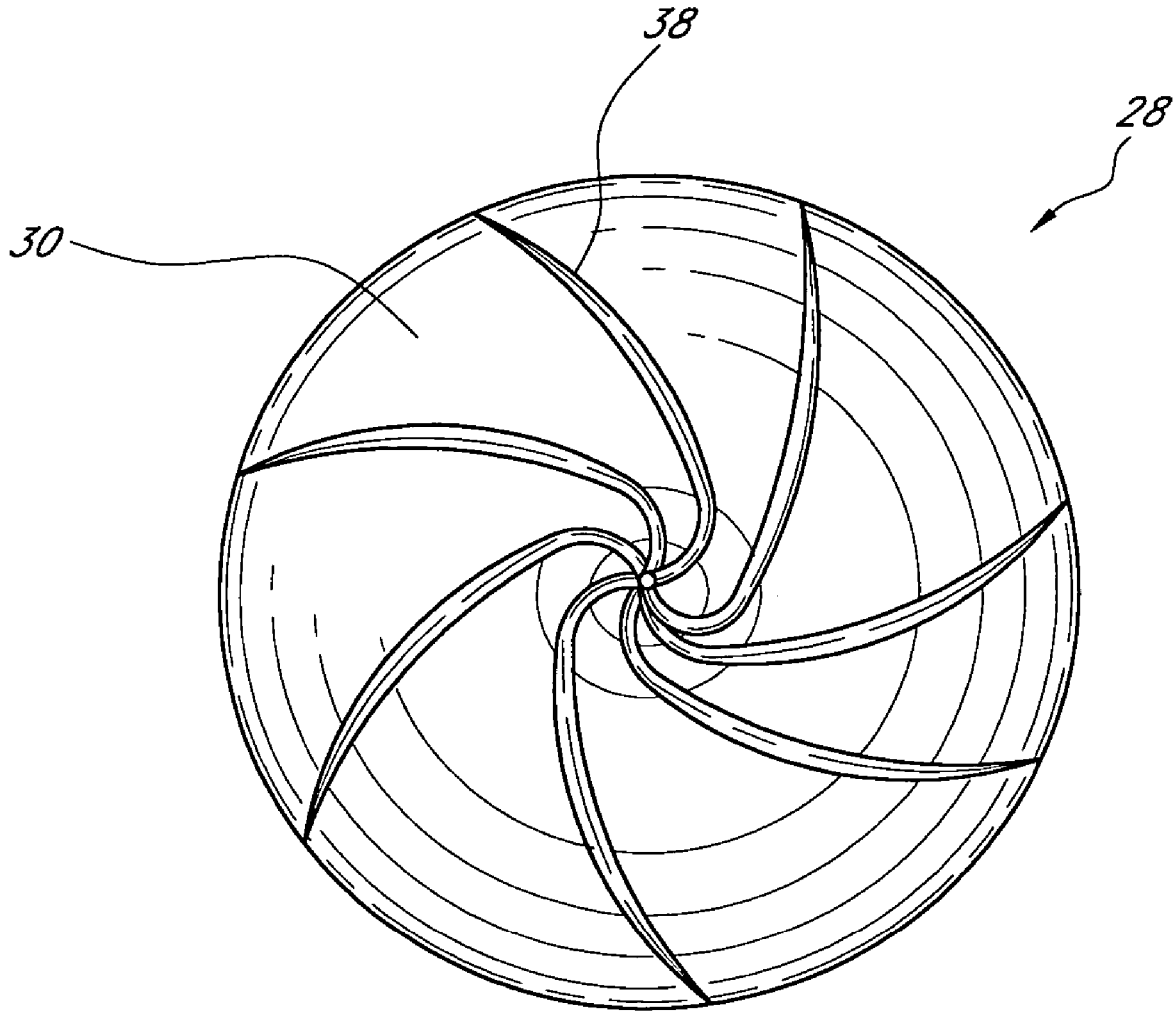
FIG. 7 shows a detailed plan view of the dispersing member of the water deflection assembly of FIG. 6.

In FIG. 6, yet another embodiment of the present invention is shown. This particular embodiment is similar to that shown in FIG. 1. The supporting pole 16 of FIG. 1 is replaced by the cup 36, which functions similarly to retain the elements of the assembly 10 in a particular configuration. The two retaining rings 22, 24 of previous embodiments are replaced by one wider retaining ring 34, which surrounds the rod 26 and contacts the rod 26 at either end of the retaining ring 34. The grooves 30 in the dispersing element 28 comprise diagonal sections defined between wires 38 that adhere to the surface of the dispersing element 28 (as best shown in FIG. 7). Thus, the water pouring from the liquid outlet 12 exerts a force against the wires 38 in order to rotate the dispersing element 28. In the embodiment represented by FIG. 6, magnets 18, 20 are used to maintain an upwards force on the rod 26 and dispersing element 28. However, as the assembly 10 is partially contained within the cup 36, this embodiment is also well-suited for replacing the magnets. Although not shown, the cup 36 may be partially filled with water, and the rod 26 may have a floating element disposed opposite the dispersing element 28 for contacting the surface of the water. This configuration may be used to create a relatively low friction interface and may allow the assembly 10 to efficiently disperse impinging water without the use of magnets.

Figure 8:
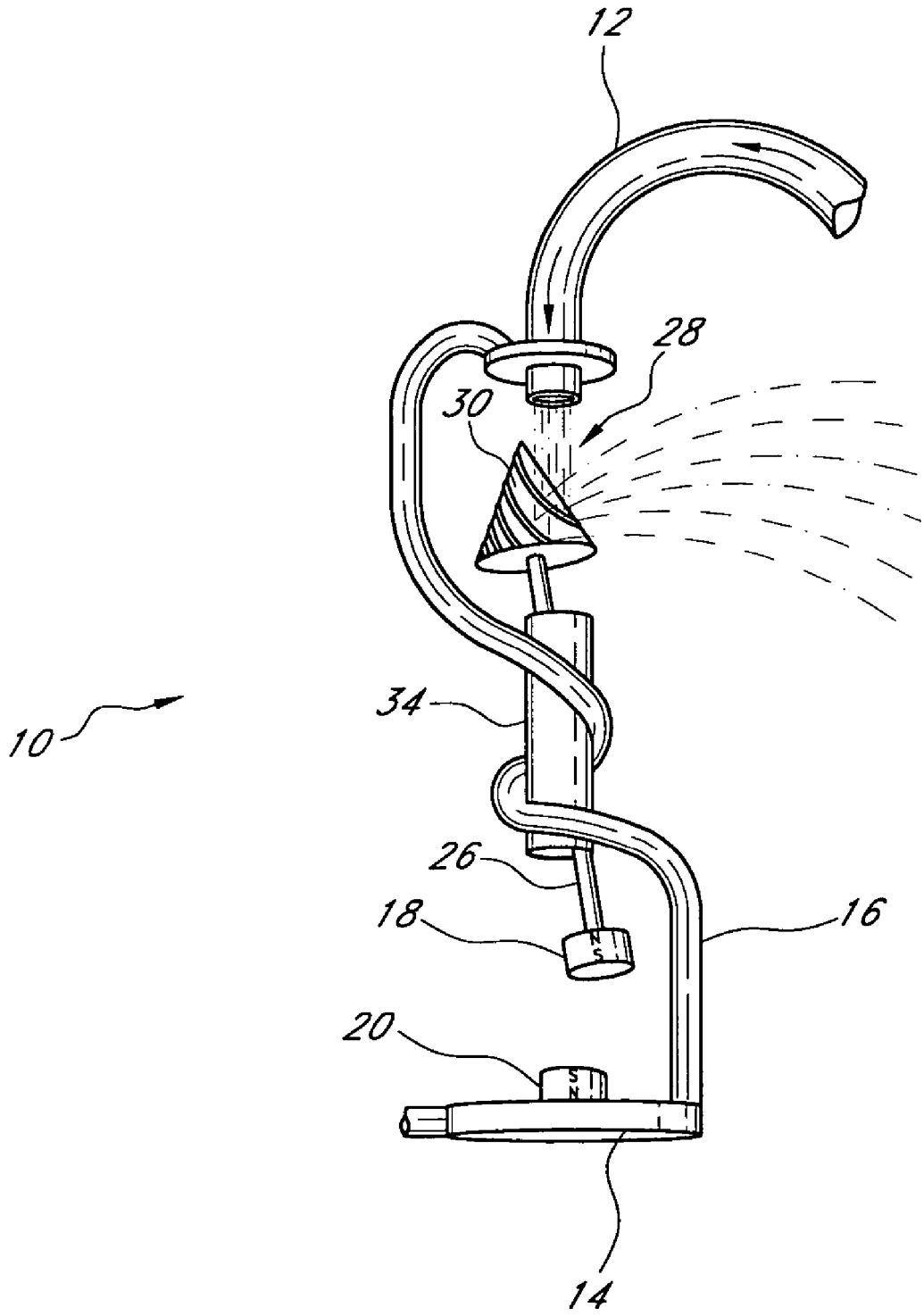
FIG. 8 shows a perspective view of a water deflection assembly according to an eighth embodiment of the present invention
Figure 9:
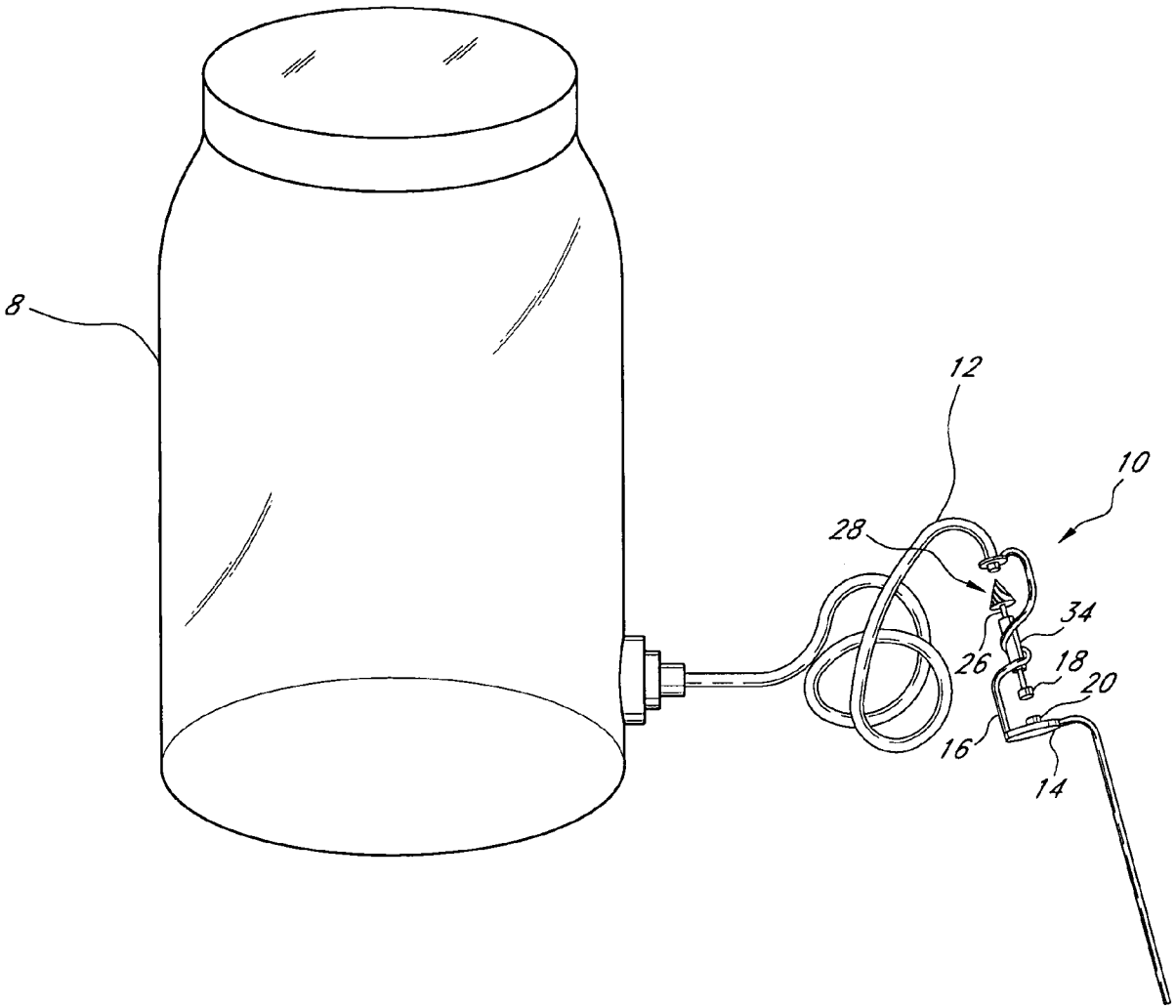
FIG. 9 shows a perspective view of a water deflection assembly according to a ninth embodiment of the present invention.
Figure 10:
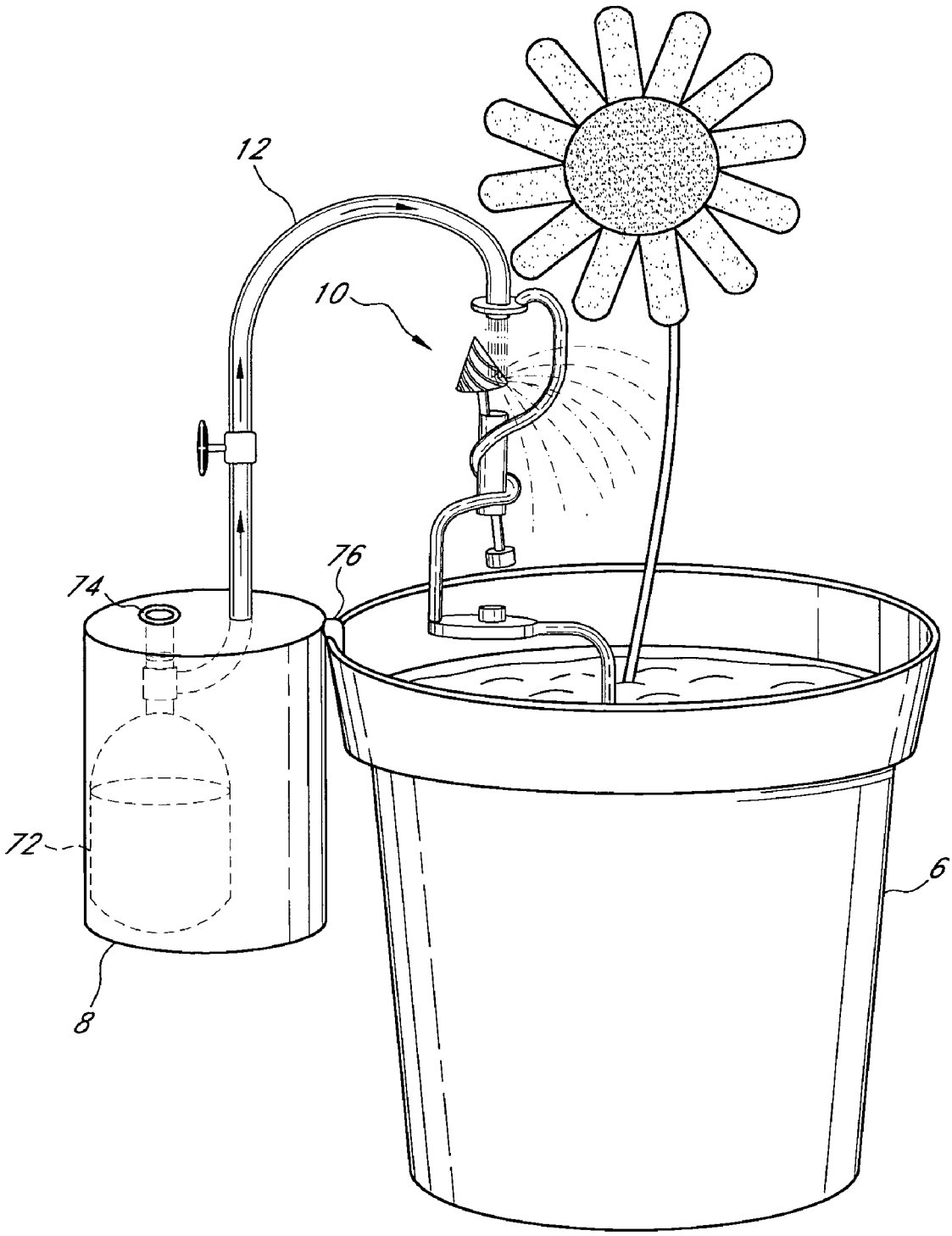
FIG. 10 shows a perspective view of a water deflection assembly according to a tenth embodiment of the present invention.

FIGS. 8-10 show another embodiment of the present invention. As illustrated, the embodiment of FIG. 8 is very similar to the embodiment of FIG. 1 and functions substantially similarly. However, the base 14, supporting pole 16 and retaining structure 34 are implemented by a unitary piece of material, preferably metal, shaped to support and retain all key elements of the assembly 10. Thus, the assembly 10, as depicted in FIG. 8, may be less expensive to manufacture. FIG. 9 shows the same assembly from FIG. 8 hydraulically connected to a container 8. Liquid from the container 8 may gravity flow to the assembly 10 through a liquid outlet 12. As is well-known to those of skill in the art, liquid in the container 8 may also be routed to the assembly 10 by a number of mechanical devices such a pump. FIG. 10 shows a variation of the embodiment shown in FIG. 9. As illustrated in FIG. 10, liquid may be directed into a container 8 through a fill port 74. For convenience, the container 8 may be attached to the top rim of a flower pot 6 using a fastener 76. The liquid is routed to the assembly 10 through a liquid outlet 12 and distributed throughout a circular area surrounding the assembly 10. The liquid may be conveyed to the assembly 10 by gravity or by creating a pressure gradient between the container 8 and the assembly 10. A simple mechanism for creating a pressure gradient is illustrated in FIG. 10. The liquid flowing through the fill port 74 fills a balloon 72 situated within the container 8. As the balloon 72 expands with liquid, its internal pressure increases above the ambient pressure at the assembly 10. This pressure difference causes the liquid to flow through the liquid outlet 12 to the assembly 10. Of course, those of skill in the art will recognize that the necessary pressure gradient may be generated in many other ways. For example, the container 8 may be equipped with a simple hand pump to manually increase the internal pressure within the container 8. To prevent the liquid from escaping the container 8 through the fill port 74, the fill port 74 may be designed to permit liquid flow only into the container 8.

Figure 11:
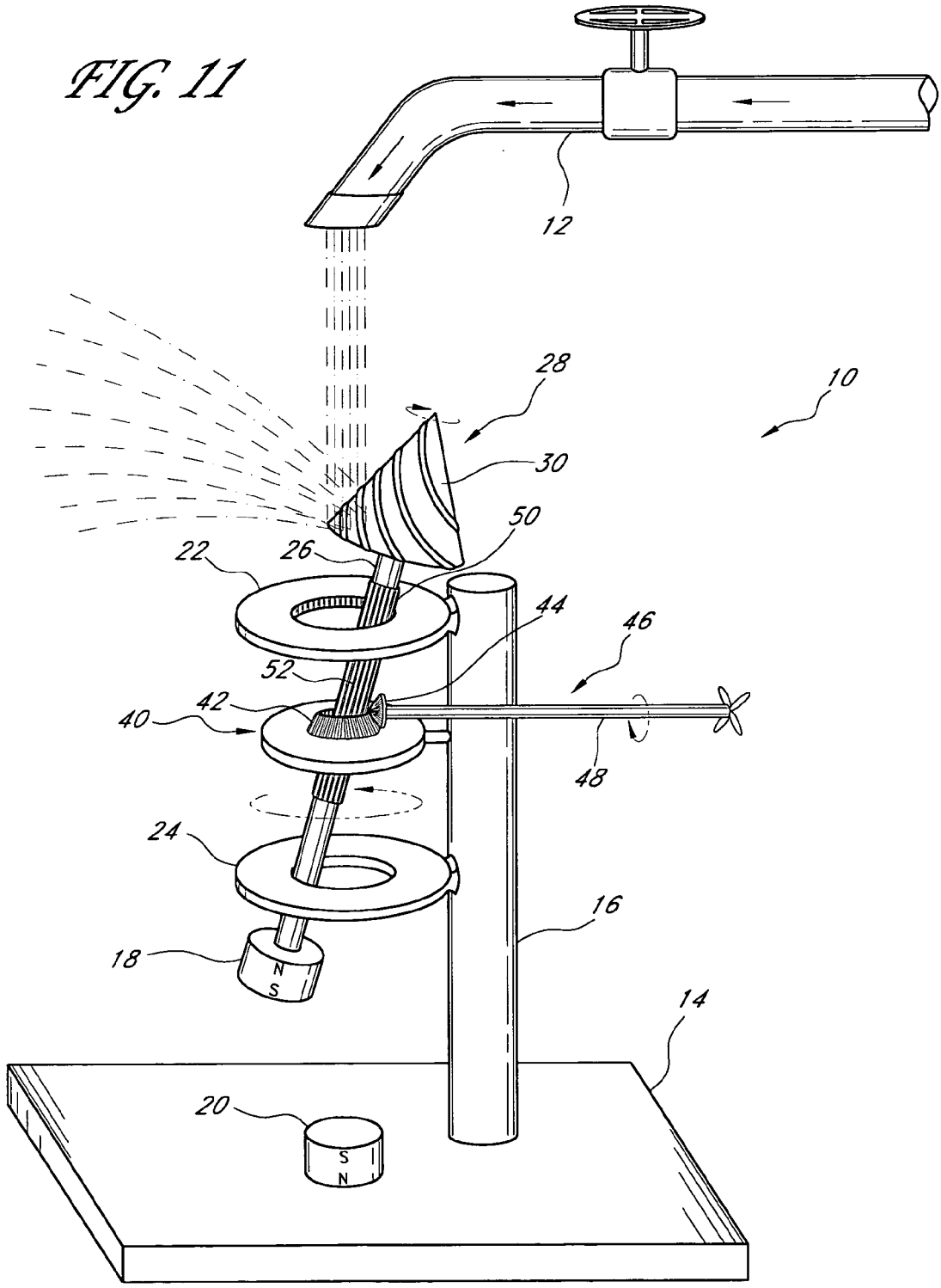
FIG. 11 shows a perspective view of a water deflection assembly according to an eleventh embodiment of the present invention.

FIG. 11 shows substantially the same assembly 10 from FIG. 1. However, a supporting ring 40 is added between the two retaining rings 22, 24. This supporting ring 40 does not act to retain the rod 26 in a desired orientation but instead supports a toothed ring 42 that may rotate with the rod 26. The toothed ring 42 may be completely disconnected from the supporting ring 40 or may be rotatably coupled to the supporting ring 40. In other embodiments, the supporting ring 40 may be replaced by some other means for supporting a freely rotatable toothed ring 42.

In order to drive the toothed ring 42, the rod 26 may also be modified to have at least a section 50 with teeth 52 disposed thereon. These teeth 52 are configured to engage the teeth of the toothed ring 42 as the rod 26 spins and precesses within the supporting and retaining rings 40, 22, 24. Thus, the rotation of the rod 26 may be converted into rotation of the toothed ring 42.

Figure 12:
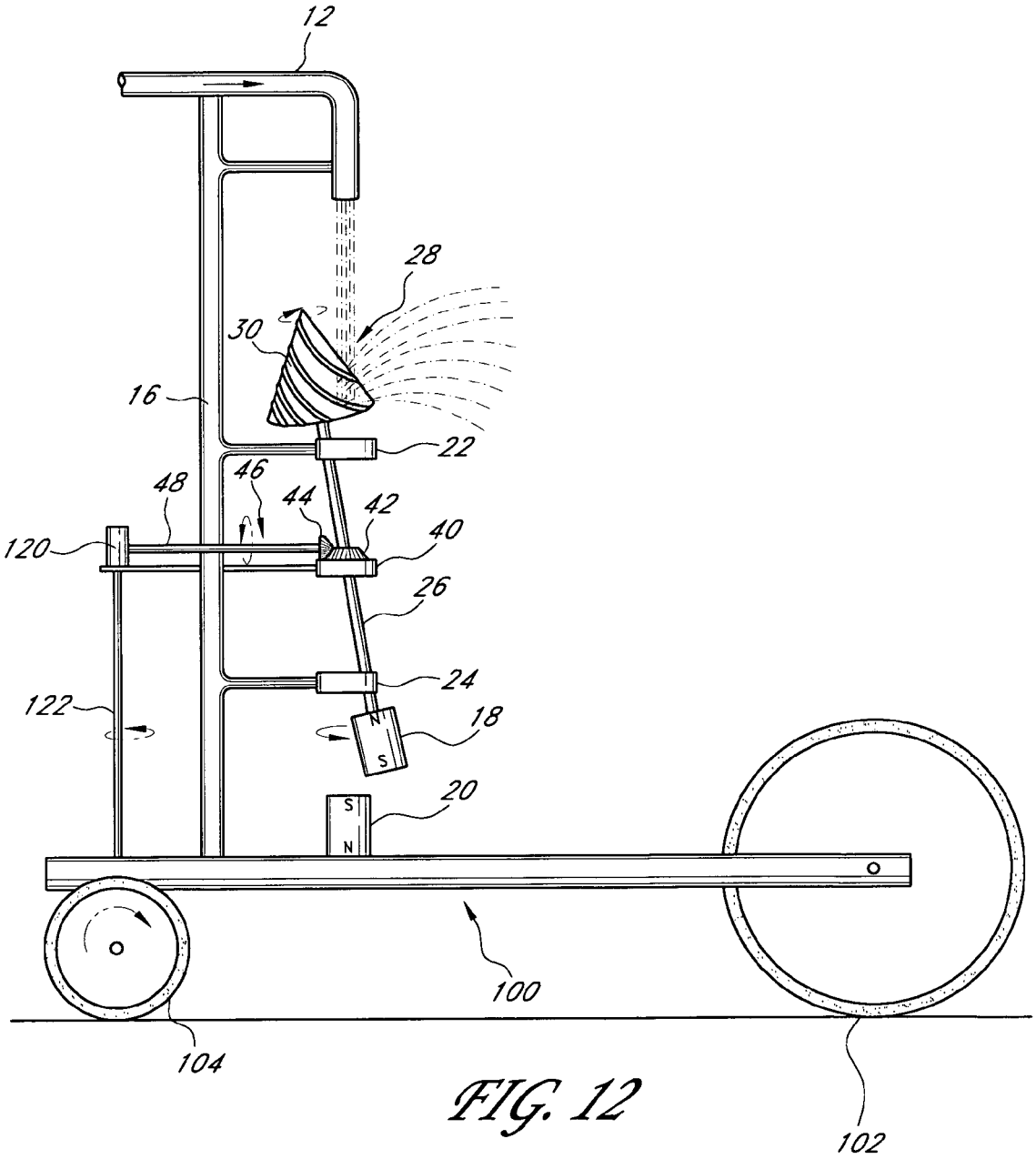
FIG. 12 shows a perspective view of a water deflection assembly according to a twelfth embodiment of the present invention.

As the toothed ring 42 rotates, it engages the gears 44 of a mechanical output 46. As is well-known to those of skill in the art, this mechanical linkage may be implemented in a number of ways. As illustrated, outwardly facing teeth of the toothed ring 42 engage the teeth of the gears 44 to turn a shaft 48. The mechanical output 46 of FIG. 11 is a simple fan, for the purposes of illustration. However, in other embodiments, the mechanical energy may be converted to drive a number of simple devices, including, for example, the wheels of a traveling sprinkler (as best shown in FIG. 12) or the drive of an oscillating nozzle. As is well known to those of skill in the art, the drag created by this mechanical output 46 may slow down the rotational speed of the rod 26, and this particular embodiment of the assembly 10 is particularly suited to higher flow applications.

In another embodiment, as described above and illustrated in FIG. 12, the mechanical energy generated by the precessing rod 26 may be used to power a number of drive wheels 104 of a traveling sprinkler 100. The rotational energy of the mechanical output 46 may be transferred to the drive wheels 104 through one or more gear assemblies 120 and shafts 122. In the embodiment depicted in FIG. 12, the traveling sprinkler 100, houses all other necessary components of the deflection assembly, including the magnet 20 to oppose the magnet 18 situated on the rod 26, the pole 16 and a support for the liquid outlet 12. In addition, one or more non-driven wheels 102 may be attached to the traveling sprinkler 102 as needed for stability or some other purpose.

Figure 13:
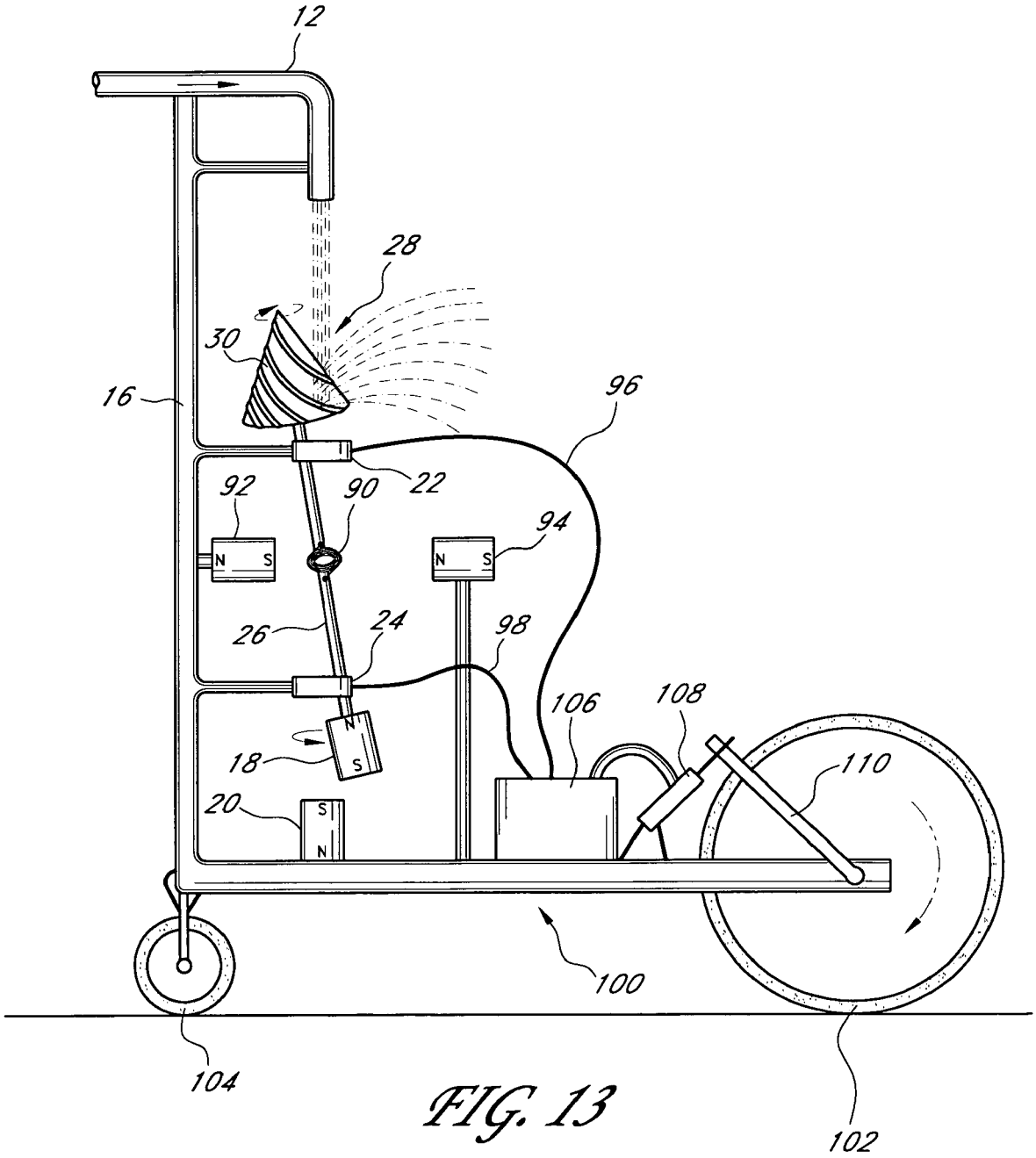
FIG. 13 shows a perspective view of a water deflection assembly according to a thirteenth embodiment of the present invention.

Of course, in other embodiments, the rotational energy of the rod 26 may be otherwise converted to a more usable form. For example, in one embodiment, a magnet may be mounted in the rod 26 and surrounded by turns of wire in order to create some electrical energy for operating a simple timer, or other electronic device, or simply to create drag to modulate the rod's rotational speed. FIG. 13 shows a substantially similar method of generating electrical energy. In this embodiment, coiled wires 90 are situated along the rod 26 between the rings 22, 24. As the coiled wires 90 rotate around the adjacent magnets 92, 94, which are situated in approximately the same horizontal plane, electrical energy is generated. Wires 96, 98 connect the retaining rings 22, 24 to a voltage amplifier and capacitor unit 106. Electrical energy is then used to power a solenoid 108, which converts the electrical energy into mechanical energy to power a wheel 102 via a ratchet lever arm 110.

Figure 14:
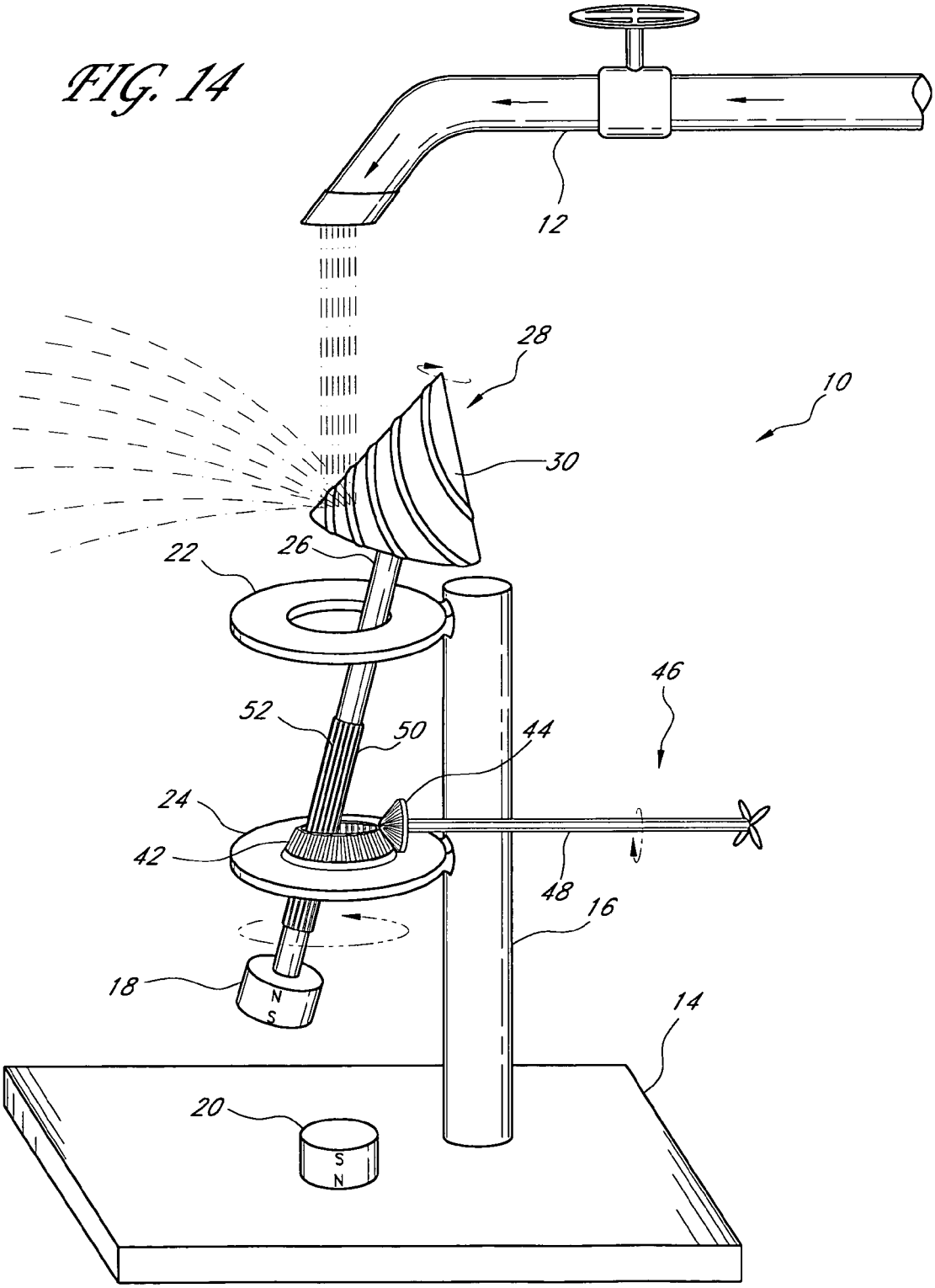
FIG. 14 shows a perspective view of a water deflection assembly according to a fourteenth embodiment of the present invention.

FIG. 14 shows another embodiment of the assembly 10 useful for capturing and converting some of the rotational energy from the rod 26. In this embodiment, a toothed ring 42 is disposed on the lower retaining ring 24. The lower retaining ring 24 may also be modified, with teeth along its inner radius. This may improve the engagement between the toothed section 50 of the rod 26 and the lower retaining ring 24 and may prevent slipping between them. The toothed ring 42 is preferably situated within a corresponding recess in the lower retaining ring 24. Ball bearings may be positioned between the outside of the toothed ring 42 and the recess in the lower retaining ring 24 to reduce friction. Alternatively, the toothed ring 42 may be held in position atop the lower retaining ring 24 by guide pins that do not affect the ability of the toothed ring 42 to rotate relative to the retaining ring 24. According to the requirements of other embodiments, the toothed ring 42 may be disposed above or below the upper or lower retaining rings.

In a preferred embodiment, the toothed ring 42 is disposed above the lower retaining ring 24 and has one fewer teeth than it. As a result, for every complete turn the rod 26 makes around the retaining ring 24, the toothed ring 42 rotates by the width of a single tooth. Thus, a significant gear ratio may be created between the assembly's mechanical output 46 and the rod 26. Such a ratio may be desirable in a number of situations to control the speed and power output at the mechanical output 46. In other embodiments, the toothed ring 42 may have even fewer teeth than the adjacent retaining ring for a different gear ratio, allowing the toothed ring 42 to turn in the opposite direction from the rod's 26 precession about the retaining ring 24. Such embodiments are preferred where, as illustrated in FIG. 14, the toothed ring 42 is located towards the middle of the rod 26. In still other embodiments, the toothed ring 42 may be configured with more teeth than the adjacent retaining ring, and the toothed ring 42 may rotate in the same direction as the rod's 26 precession. Such embodiments are preferred where the toothed ring 42 is located distally from the middle of the rod, adjacent the outwardly facing surface of an adjacent retaining ring.

Figure 15:
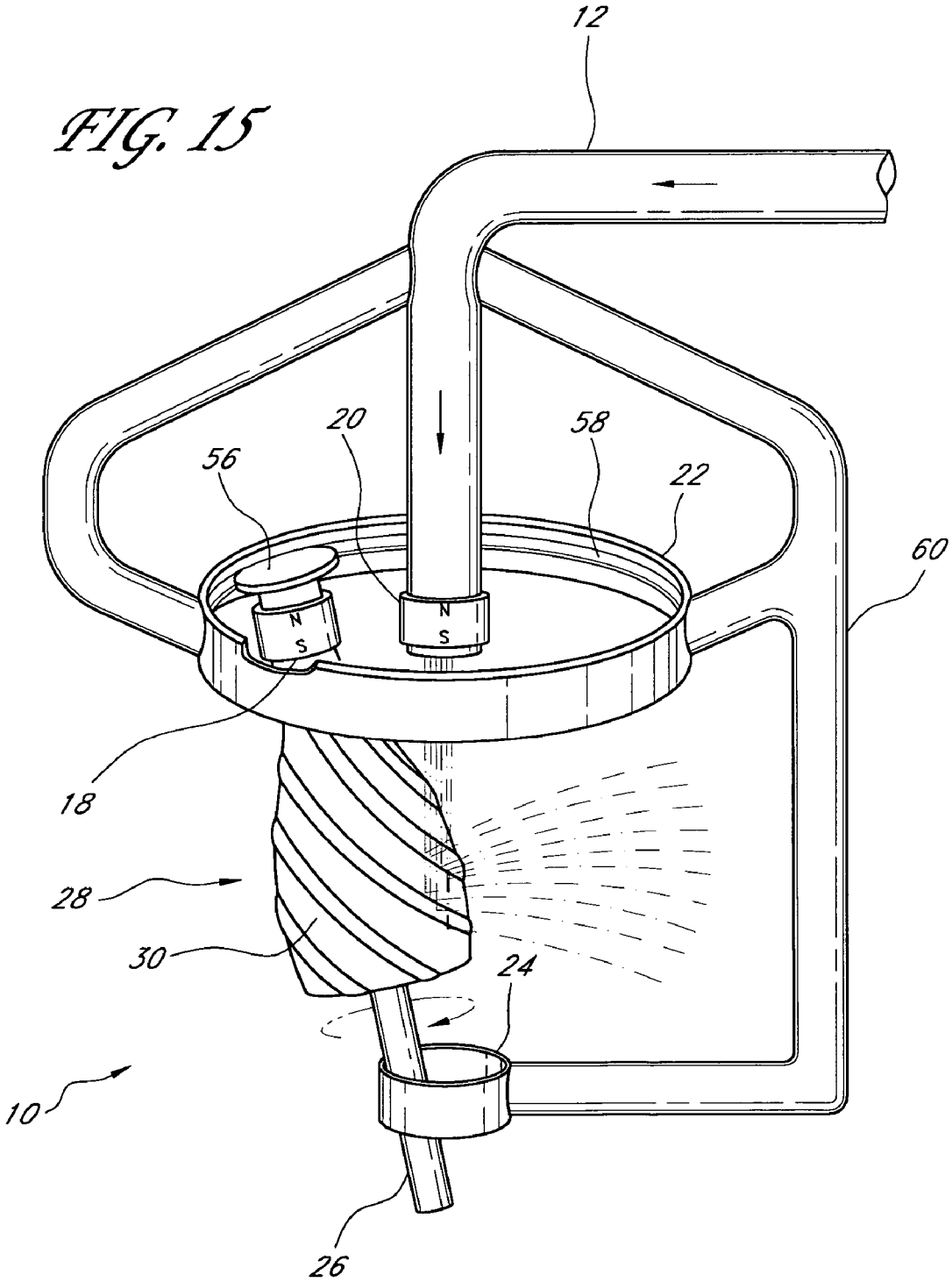
FIG. 15 shows a perspective view of a water deflection assembly according to a fifteenth embodiment of the present invention.

In FIG. 15, yet another embodiment of the present invention is shown. In this embodiment, constructed somewhat similarly to that of FIG. 4, the retaining rings 22, 24 have differing radii, the magnet 18 is disposed near the upper end of the rod 26, and the magnet 20 is disposed above the magnet 18 and near the center of the retaining ring 22. As a result, the magnetic force between the two magnets 18, 20 imposes a significant outwardly directed component on the rod 26, which is partially redirected upwards by the rod's interaction with the ring 22.

Like the rod of FIG. 4, the rod 26 has a varying radius along its length, and, in a preferred embodiment, the ratio of the rod's circumference to the adjacent ring's circumference remains constant. As a result, the rod 26 and dispersing element 28 precess similarly to the above embodiments, but, as illustrated, the rod 26 lies against the same side of both retaining rings 22, 24, as this orientation now minimizes the potential energy of the system.

The rod 26 further comprises a disc member 56 that is configured to roll within a hollow track 58 on the inner radius of the upper retaining ring 22. In this way, the assembly 10 can be made more secure, and the path of the water exiting the assembly 10 made more predictable. The disc member 56 may be fixed to or rotatable relative to the rod 26. The supporting pole 16 and base 14 of previous embodiments are replaced, in the embodiment of FIG. 15, by a single frame component 60 that orients the parts of the assembly 10 relative to each other.

Figure 16:
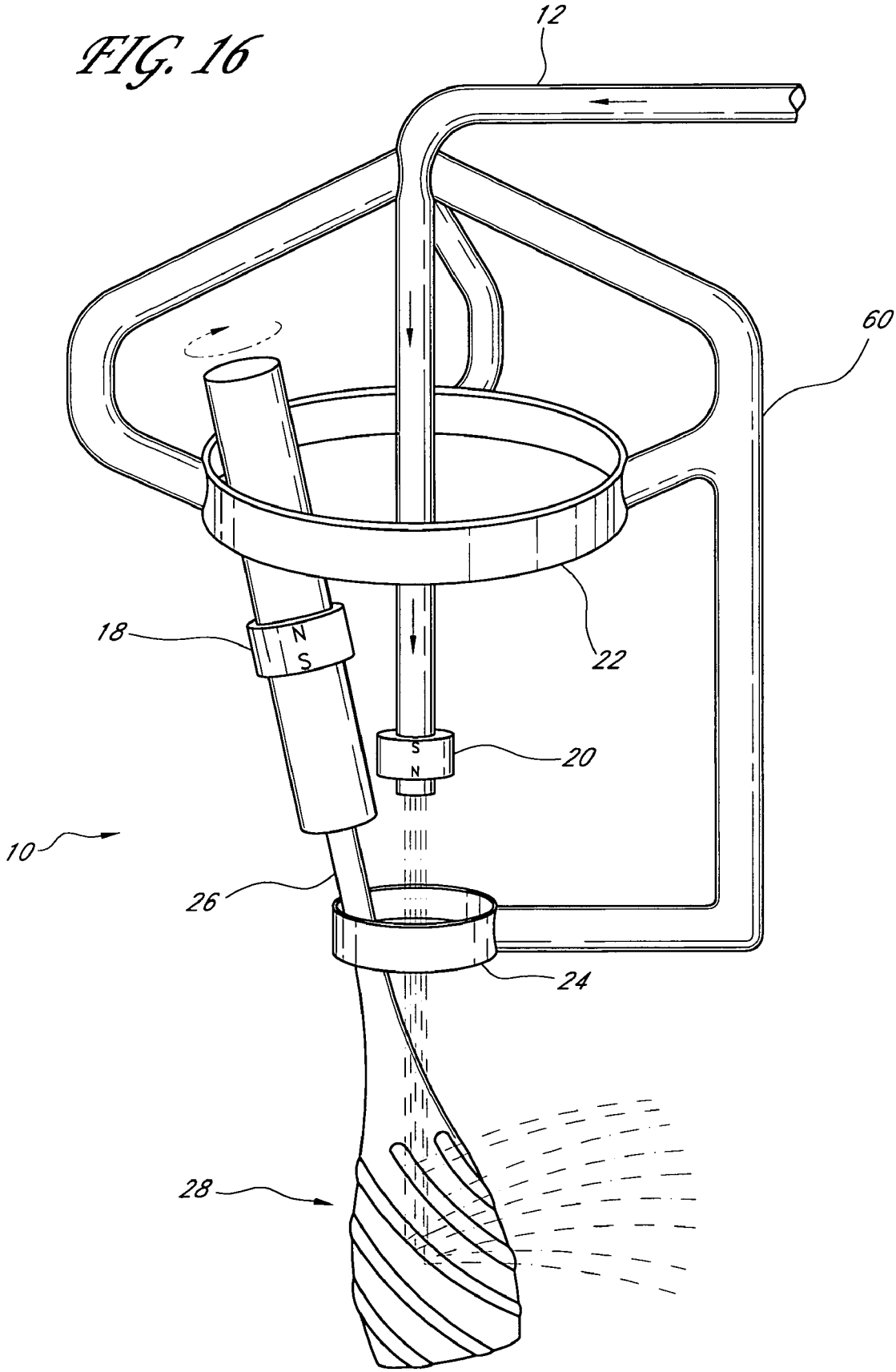
FIG. 16 shows a perspective view of a water deflection assembly according to a sixteenth embodiment of the present invention.

In FIG. 16, yet another embodiment of the present invention is shown. This embodiment may be constructed very similarly to that of FIG. 15 or FIG. 4. The retaining rings 22, 24 have differing radii, the magnet 18 is disposed near the upper end of the rod 26, and the magnet 20 is disposed below the magnet 18 and is trapped above the nozzle for the fluid. As with the embodiment of FIG. 15, the supporting pole 16 and base 14 of previous embodiments are replaced by a single frame component 60. Finally, the dispersing element 28 is moved below the lower retaining ring 24, in order to allow the water to fall more freely without interacting with other elements of the assembly 10. This embodiment also demonstrates that the particular placement of the dispersing element 28 is not essential for the working of the assembly 10.

Figure 17:
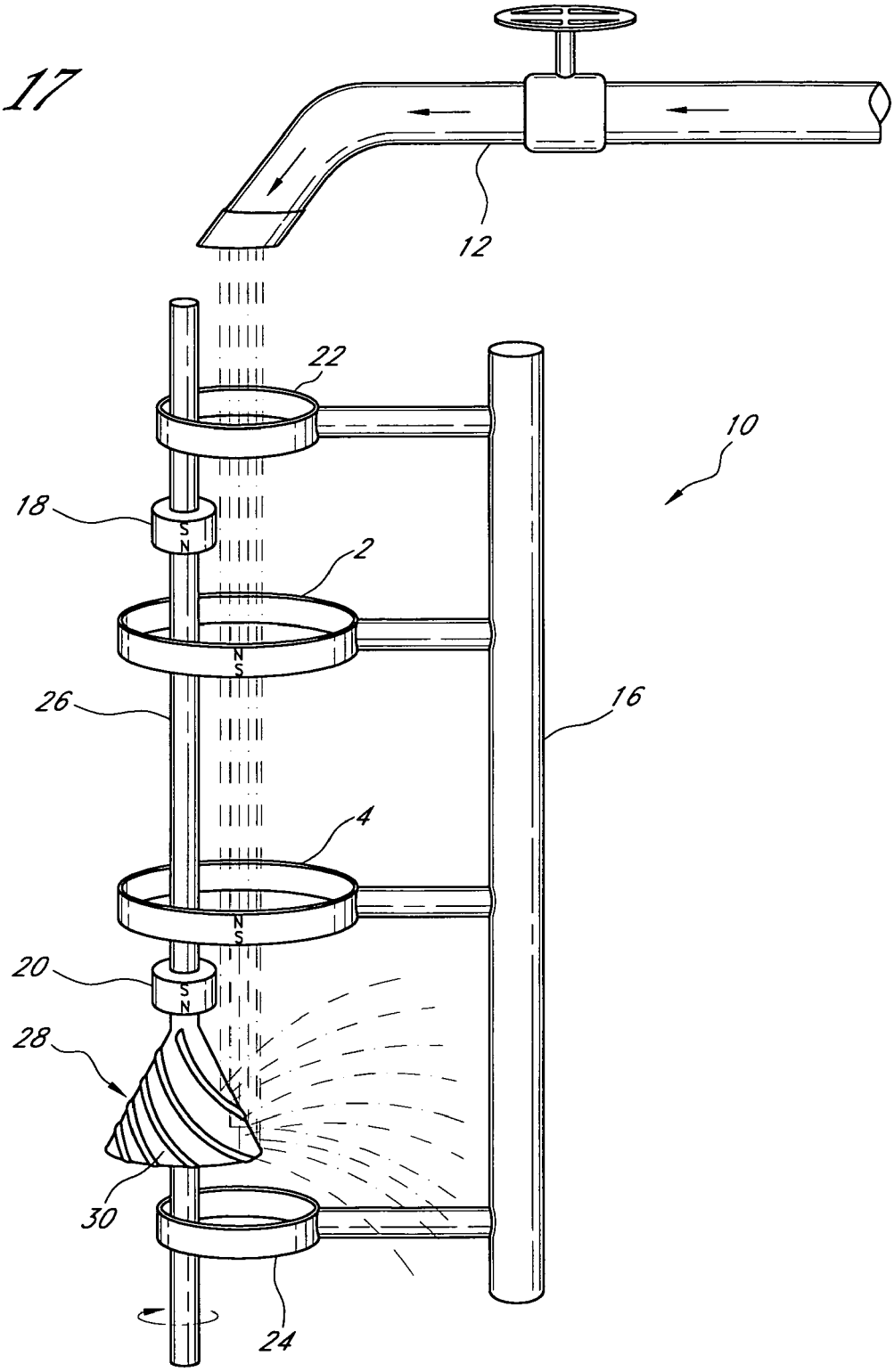
FIG. 17 shows a perspective view of a water deflection assembly according to a seventeenth embodiment of the present invention.

In FIG. 17, yet another embodiment of the assembly is shown. Two magnetized rings 2, 4 are situated between the retaining rings 22, 24. The retaining rings 22, 24, the magnetized rings 2, 4 and the discharge nozzle of the liquid outlet 12 are all positioned along substantially the same vertical centerline. In the embodiment shown, the dispersing element 28 is located between the lower magnetized ring 4 and the lower retaining ring 24. In addition, two magnets 18, 20 are disposed along the rod 26, one above the upper magnetized ring 2 and one below the lower magnetized ring 4. The upper magnet 18 is situated above the upper magnetized ring 2 and is oriented to oppose the polarity of the upper magnetized ring 2. Likewise, the lower magnet 20 is situated below the lower magnetized ring 4 and is oriented to oppose the polarity of the lower magnetized ring 4. As the result of the opposing magnetic fields, the rod 26 remains vertically suspended in such a manner that the magnetic rings 2, 4 are located between the rod-mounted magnets 18, 20. The liquid outlet 12 directs liquid through the upper retaining ring 22, the two magnetized rings 2, 4 and onto the surface of the dispersing element 28. As in the other embodiments, contact by the liquid causes the dispersing element 28 and the rod 26 to spin about their axes and rotate around the retaining rings 22, 24. As a result, the liquid is dispersed in various directions in a circular pattern around the dispersing member 28.

Figure 18:
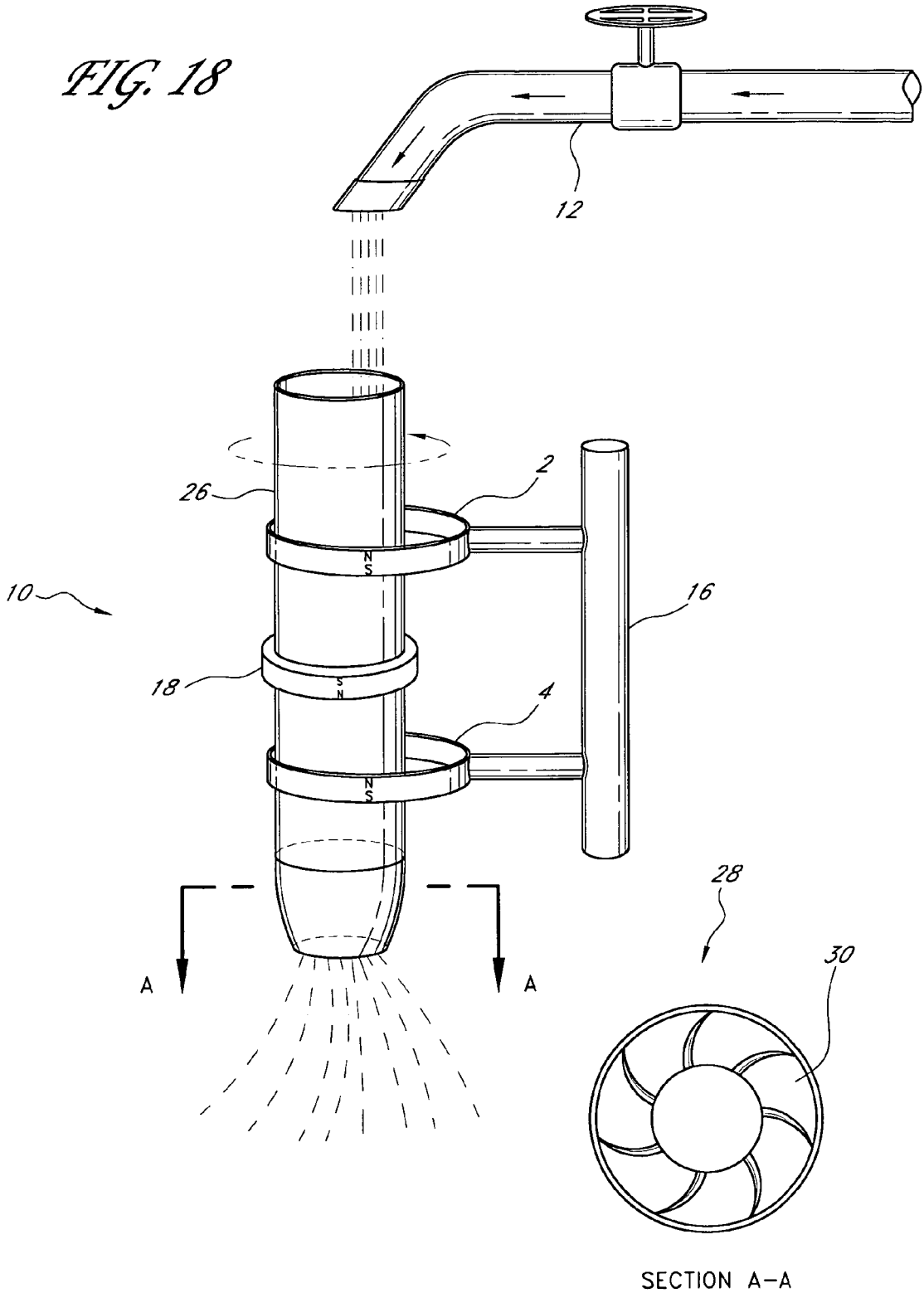
FIG. 18 shows a perspective view of a water deflection assembly according to an eighteenth embodiment of the present invention.

FIG. 18 shows yet another embodiment of the assembly 10. In this embodiment, a ring magnet 18 is attached to the outside of the hollow rod 26 and is positioned between two magnetized retaining rings 2, 4 that restrain the hollow rod 26. The magnet 18 is oriented to oppose the magnetic fields of both magnetized retaining rings 2, 4. This permits the hollow rod 26 to maintain a vertical position where the ring magnet 18 disposed on the hollow rod 26 is always positioned between the adjacent magnetized retaining rings 2, 4. A dispersing element 28 is situated on the interior, lower end of a hollow rod 26. As liquid from the liquid outlet 12 is directed inside the hollow rod 26, liquid contacts the grooves 30 of the dispersing element 28, causing the liquid to be deflected through the lower opening of the hollow rod 26 in a substantially radial direction away from the hollow rod 26. As in the previous embodiments of the dispersing element 28, the liquid contact causes the dispersing element 28 to rotate about its longitudinal axis. Consequently, the hollow rod 26 precesses around the magnetized retaining rings 2, 4, causing the liquid to be deflected in various radial directions around the assembly 10.

Figure 19:
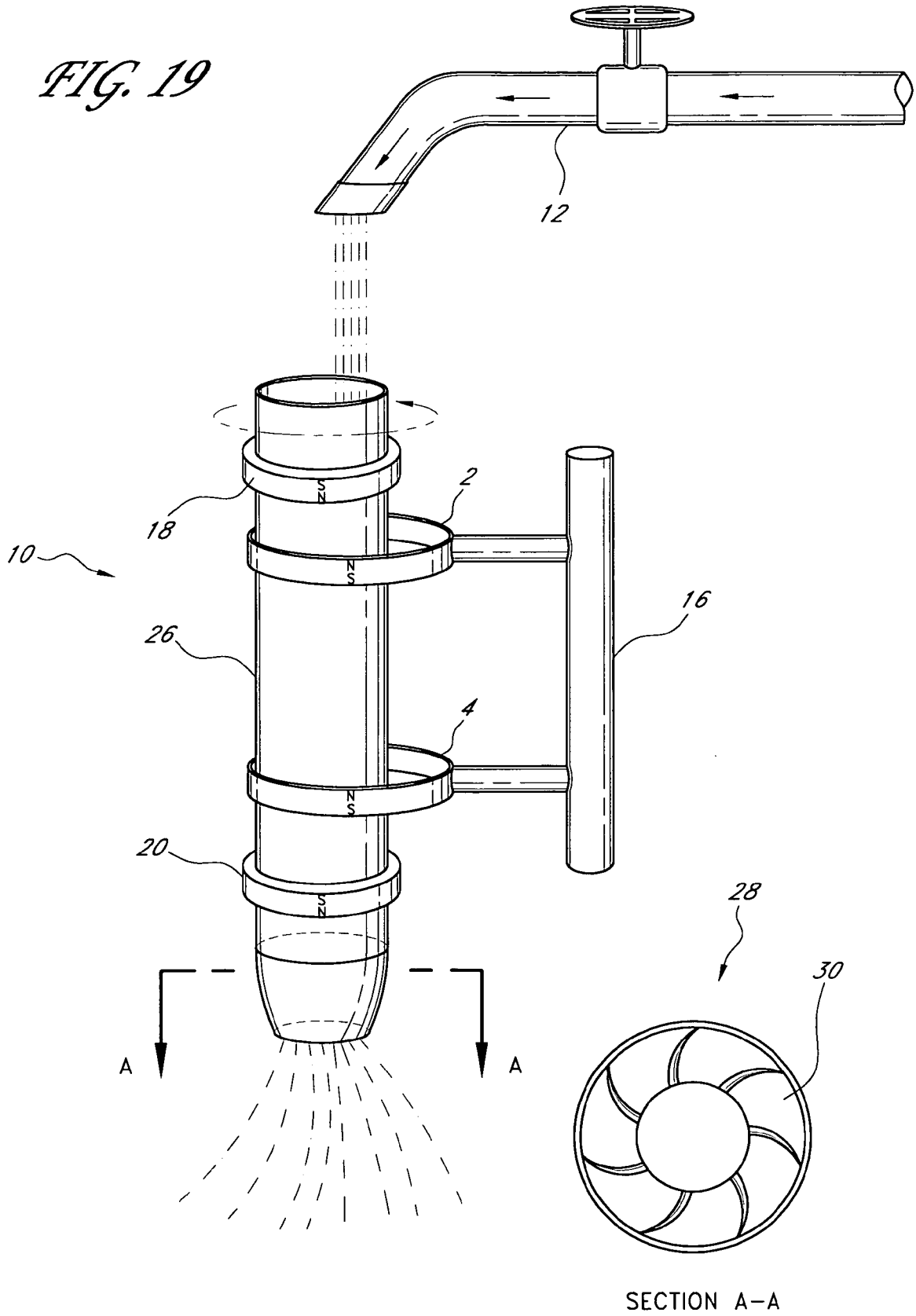
FIG. 19 shows a perspective view of a water deflection assembly according to a nineteenth embodiment of the present invention.

Of course, the vertical orientation of the hollow rod 26 may be maintained by multiple variations of opposing magnetic systems. For example, in FIG. 19, the vertical location of the hollow rod 26 is maintained by positioning two ring magnets 18, 20 on the exterior of the hollow rod 26. In this embodiment, an upper ring magnet 18 is positioned above the upper magnetized retaining ring 2 and another ring magnet 20 is positioned below the lower magnetized retaining ring 4. Those of skill in the art will recognize that the exact number and orientation of ring magnets and magnetized retaining rings is not important, so long as the opposing magnetic forces that are generated are sufficient to maintain the vertical position of the hollow rod 26.

In all of the above embodiments, factors may cause or combine to cause the rod 26 to move out of a desired orientation during operation. For example, in a resting configuration, the rod 26 of FIG. 1 contacts the two retaining rings 22, 24 at locations 180 degrees apart, thus minimizing the potential energy of the system. However, as the rod 26 spins and precesses during use, the points at which it contacts the two retaining rings 22, 24 may move less out of phase. This phenomenon may be caused by a number of factors.

For example, if the retaining rings 22, 24 have slight variations in size, due to their manufacture or as a result of wear and tear, one end of the rod 26 may orbit its respective ring faster than the other end of the rod 26, and this faster precession may overcome those stabilizing forces that act to minimize the potential energy of the system. As another example, if there is more friction at one retaining ring-rod interface, the rod 26 may precess faster at the lower friction interface, and one end of the rod 26 may drag relative to the lower friction interface at the opposite end of the rod 26. Thus, the optimum state of precession may not be realized. This frictional variation may be caused by the characteristics of the retaining ring and rod surfaces, by weight variations in the rod 26, or by the deliberate addition of a mechanical device at one end, as shown above in FIG. 11.

In different embodiments, various ways of overcoming these problems may be implemented. In one embodiment, the weight distribution along the rod 26 may be varied. In another embodiment, the diameter of the rod 26 in contact with the retaining ring may be varied. In still another embodiment, the angle at which the rod 26 lies against the retaining ring may be varied. In another embodiment, the placement and angle of the water deflecting grooves 30 on the dispersing element 28 or the diameter and shape of the dispersing element 28 itself may be varied. The placement of the dispersing element 28 or magnet 18 along the rod 26 may also be varied in order to vary the force and pressure of the rod 26 against either retaining ring. Of course, adjustments may also be made to the diameters of either the upper or lower retaining rings, and gear teeth may be added or subtracted from toothed rings to affect the movement of the rod 26 relative to the ring.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. For example, variations of the assembly 10 may be well-suited for use in fountains, shower heads, dishwashers, low flow hose nozzles, and many industrial applications. It also is contemplated that various aspects and features of the invention described can be practiced separately, combined together, or substituted for one another, and that a variety of combinations and subcombinations of the features and aspects can be made and still fall within the scope of the invention. For example, an assembly 10 may be constructed without the need for an opposing magnetic system. Such an assembly 10 may rely on the force created by liquid contacting the dispersing element 28, the force of gravity, and/or centrifugal forces to counteract one another. Moreover, the different elements of these assemblies 10 may be constructed from a number of different suitable materials well known to those of skill in the art, including rust-proof metallic surfaces, polymeric surfaces, ceramics, and other materials. Thus, it is intended that the scope of the present invention herein disclosed should not be limited by the particular disclosed embodiments described above.

What is claimed is:

1. A device for dispersing liquid, comprising:

an elongated member;

a dispersing element attached to the elongated member;

at least one deflecting groove situated on the dispersing element;

at least one retaining structure surrounding the elongated member and confining movement of the elongated member;

at least one set of magnets maintaining the elongated member above a base surface and within the at least one retaining structure, said one set of magnets including a first magnet having a first polarity provided on the base surface;

a second magnet having a second polarity attached to the elongated member such that said first and second polarities oppose each other;

wherein liquid directed towards the dispersing element is deflected by the at least one deflecting groove in a generally radial direction away from the dispersing element;

wherein the deflection of the liquid away from the dispersing element causes the dispersing element and the elongated member to rotate about a common longitudinal axis;

wherein the rotation of the dispersing element and the elongated member causes the elongated member to precess within the at least one retaining structure; and wherein the liquid contacts the dispersing element as it precesses, causing the liquid to be distributed throughout a generally circular area around the device.

2. The device as claimed in claim 1, further comprising a base comprising said base surface and connected to the retaining structure.

3. The device as claimed in claim 1, wherein the dispersing element has a conical shape.

4. The device as claimed in claim 1, wherein the retaining structure comprises at least one ring.

5. A device for dispersing liquid, comprising:

an elongated member;

a dispersing element attached to the elongated member;

at least one deflecting groove situated on the dispersing element;

at least one retaining structure surrounding the elongated member and confining movement of the elongated member;

at least one set of magnets maintaining the elongated member above a base surface and within the at least one retaining structure, said one set of magnets including a first magnet having a first polarity provided on the base surface;

a second magnet having a second polarity attached to the elongated member such that said first and second polarities oppose each other;

wherein liquid directed towards the dispersing element is deflected by the at least one deflecting groove in a generally radial direction away from the dispersing element;

wherein the deflection of the liquid away from the dispersing element causes the dispersing element and the elongated member to rotate about a common longitudinal axis;

wherein the rotation of the dispersing element and the elongated member causes the elongated member to precess within the at least one retaining structure; and wherein the liquid contacts the dispersing element as it precesses, causing the liquid to be distributed throughout a generally circular area around the device;

wherein the retaining structure comprises at least one upper retaining ring and at least one lower retaining ring oriented along the same longitudinal axis; and wherein the dispersing element is situated above the at least one upper retaining ring.

6. The device as claimed in claim 1, wherein at least one magnet is provided on a lower end of the elongated member.

7. The device as claimed in claim 1, further comprising a supporting pole connecting the base surface to the retaining structure.

8. A device for dispersing liquid, comprising:

An elongated member;

a dispersing element provided on the elongated member; and a retaining structure for supporting the elongated member;

wherein liquid directed towards the dispersing element is deflected by the dispersing element in a generally radial direction away from the dispersing element;

wherein the deflection of the liquid away from the dispersing element causes the dispersing element and the elongated member to rotate about a common longitudinal axis;

wherein the rotation of the dispersing element and the elongated member causes the elongated member to precess within the retaining structure; and wherein the liquid contacts the dispersing element as it precesses, causing the liquid to be distributed throughout a generally circular area around the device; and wherein the elongated member is maintained above a base surface using at least one set of oppositely oriented magnets.

9. The device as claimed in claim 8, wherein the dispersing element comprises at least one deflecting groove.

10. The device as claimed in claim 8, wherein the dispersing element has a conical shape.

11. The device as claimed in claim 8, wherein the at least one set of oppositely oriented magnets comprises a first magnet situated on the elongated member and a second magnet situated near the first magnet and oriented to oppose the magnetic field of the first magnet.

12. The device as claimed in claim 11, wherein the second magnet is incorporated into at least a portion of the retaining structure.

13. The device as claimed in claim 8, wherein the elongated member is hollow, having a first opening and a second opening;

wherein the dispersing element is situated on the interior of the hollow elongated member near the second opening;

wherein liquid directed through the first opening of the hollow elongated member contacts the dispersing element and is deflected by at least one deflecting groove in a generally radial direction away from the elongated member through the second opening in the elongated member.

14. A sprinkler device comprising:

a liquid outlet adapted to be connected to a source of liquid under pressure;

a first member having a liquid dispensing element attached at one end thereof, said dispensing element located proximate said liquid outlet and having at least one groove therein;

said first member and said water dispensing element having a support structure enabling both spinning and wobbling motion when liquid from said liquid outlet impinges on said dispensing element;

a pair of magnets including a first magnet mounted on said first member and a second magnet mounted a portion of said support structure proximate said first magnet, with like poles of said first and second magnets opposing each other to create a repelling force that causes said first member to resist movement in a direction towards said second magnet; and wherein said repelling force is in a direction substantially opposite a direction of flow of liquid from said liquid outlet, said flow of liquid causing said first member to move towards said second magnet thereby increasing said repelling force.

15. The sprinkler device of claim 14 wherein said dispensing element has a plurality of grooves therein shaped and arranged to cause said dispensing element to spin about its own axis when liquid impinges on said dispensing element.

16. The sprinkler device of claim 14 wherein said dispensing element and said first member spin about a common axis.

17. The sprinkler device of claim 14 wherein said first and second magnets are generally axially spaced.

18. The sprinkler device of claim 14 wherein said first and second magnets are located to one side of said support structure.

19. A liquid deflection assembly comprising a moveable component mounting a liquid dispensing element; at least one fixed component loosely supporting said first component and shaped so as to permit said first moveable component and said liquid dispensing element to simultaneously spin and precess when a liquid impinges on said dispensing element; a first magnet supported on said moveable component and a second magnet supported on said fixed component, said first and second magnets having like poles facing each other and positioned so as to establish a repelling force on said moveable component in a direction substantially opposite a direction of flow of liquid from said liquid outlet, such that the flow of liquid increases the repelling force, and wherein said repelling force serves to tilt said moveable component relative to said fixed component.

20. The sprinkler device of claim 19 wherein said dispensing element has a plurality of grooves therein shaped and arranged to cause said dispensing element to spin about an axis of said dispensing element when liquid impinges on said dispensing element.

21. The sprinkler device of claim 19 wherein said dispensing member and said moveable component spin about a common axis.

22. The sprinkler device of claim 19 wherein said first and second magnets are generally axially spaced.

23. The sprinkler device of claim 19 wherein both magnets are located to one side of said fixed component.

* * * * *